US009598940B2

(12) United States Patent
Rodgers et al.

(10) Patent No.: US 9,598,940 B2
(45) Date of Patent: Mar. 21, 2017

(54) PERFORATION GUN STRING ENERGY PROPAGATION MANAGEMENT SYSTEM AND METHODS

(71) Applicant: HALLIBURTON ENERGY SERVICES, INC, Houston, TX (US)

(72) Inventors: John P. Rodgers, Southlake, TX (US); Marco Serra, Dinhard (CH); Timothy S. Glenn, Dracut, MA (US); John D. Burleson, Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 761 days.

(21) Appl. No.: 14/004,678

(22) PCT Filed: Sep. 19, 2012

(86) PCT No.: PCT/US2012/056165
§ 371 (c)(1),
(2) Date: Sep. 11, 2013

(87) PCT Pub. No.: WO2014/046656
PCT Pub. Date: Mar. 27, 2014

(65) Prior Publication Data

US 2014/0076564 A1 Mar. 20, 2014

(51) Int. Cl.
*E21B 43/116* (2006.01)
*E21B 43/117* (2006.01)

(52) U.S. Cl.
CPC ..... *E21B 43/116* (2013.01); *E21B 43/117* (2013.01)

(58) Field of Classification Search
CPC .... E21B 17/07; E21B 43/116; E21B 43/1195; E21B 43/11; E21B 17/06; E21B 17/02
See application file for complete search history.

(56) References Cited

U.S. PATENT DOCUMENTS 2,833,213 A 5/1958 Udry
2,980,017 A 4/1961 Castel
3,057,296 A 10/1962 Silverman
(Continued)

FOREIGN PATENT DOCUMENTS

GB 2406870 A 4/2005
WO 2004076813 A1 9/2004
(Continued)

OTHER PUBLICATIONS

Rodgers, John P., et al., PCT Application entitled "Sensing Shock During Well Perforation", filed Dec. 17, 2010, App. No. PCT/US10/66102.
(Continued)

*Primary Examiner* — Daniel P Stephenson
(74) *Attorney, Agent, or Firm* — Chamberlain Hrdlicka

(57) ABSTRACT

A perforation tool assembly. The perforation tool assembly comprises a tool string connector, a perforation gun coupled to the tool string connector, and a structure configured to absorb mechanical energy released by firing one or more perforation guns. The coupling is configured to provide a limited range of motion of the tool string connector relative to the perforation gun. The tool string connector and the perforation gun retain the structure configured to absorb mechanical energy.

20 Claims, 10 Drawing Sheets

(56) References Cited

U.S. PATENT DOCUMENTS 3,128,825 A 4/1964 Blagg
3,143,321 A 8/1964 McGehee et al.
3,208,378 A 9/1965 Boop
3,216,751 A 11/1965 Der Mott
3,394,612 A 7/1968 Bogosoff et al.
3,414,071 A 12/1968 Alberts
3,599,719 A 8/1971 Brown
3,653,468 A 4/1972 Marshall
3,687,074 A 8/1972 Andrews et al.
3,779,591 A 12/1973 Rands
3,923,105 A 12/1975 Lands, Jr.
3,923,106 A 12/1975 Bosse-Platiere
3,923,107 A 12/1975 Dillard
3,971,926 A 7/1976 Gau et al.
4,269,063 A 5/1981 Escaron et al.
4,319,526 A 3/1982 DerMott
4,346,795 A 8/1982 Herbert
4,409,824 A 10/1983 Salama et al.
4,410,051 A 10/1983 Daniel et al.
4,419,933 A 12/1983 Kirby et al.
4,480,690 A 11/1984 Vann
4,575,026 A 3/1986 Brittain et al.
4,598,776 A 7/1986 Stout
4,612,992 A 9/1986 Vann et al.
4,619,333 A 10/1986 George
4,637,478 A 1/1987 George
4,679,669 A 7/1987 Kalb et al.
4,693,317 A 9/1987 Edwards et al.
4,694,878 A 9/1987 Gambertoglio
4,764,231 A 8/1988 Slawinski et al.
4,817,710 A 4/1989 Edwards et al.
4,829,901 A 5/1989 Yates, Jr.
4,830,120 A 5/1989 Stout
4,842,059 A 6/1989 Tomek
4,901,802 A 2/1990 George et al.
4,913,053 A 4/1990 McPhee
4,971,153 A 11/1990 Rowe et al.
5,027,708 A 7/1991 Gonzalez et al.
5,044,437 A 9/1991 Wittrisch
5,078,210 A 1/1992 George
5,088,557 A 2/1992 Ricles et al.
5,092,167 A 3/1992 Finley et al.
5,103,912 A 4/1992 Flint
5,107,927 A 4/1992 Whiteley et al.
5,109,355 A 4/1992 Yuno
5,117,911 A 6/1992 Navarette et al.
5,131,470 A * 7/1992 Miszewski ..... E21B 17/07 166/297
5,133,419 A 7/1992 Barrington
5,161,616 A 11/1992 Colla
5,188,191 A 2/1993 Tomek
5,216,197 A 6/1993 Huber et al.
5,287,924 A 2/1994 Burleson et al.
5,320,169 A 6/1994 Delatorre
5,343,963 A 9/1994 Bouldin et al.
5,351,791 A 10/1994 Rosenzweig
5,366,013 A 11/1994 Edwards et al.
5,421,780 A 6/1995 Vukovic
5,529,127 A 6/1996 Burleson et al.
5,547,148 A 8/1996 Del Monte et al.
5,598,891 A 2/1997 Snider et al.
5,598,894 A 2/1997 Burleson et al.
5,603,379 A 2/1997 Henke et al.
5,667,023 A 9/1997 Harrell et al.
5,774,420 A 6/1998 Heysse et al.
5,778,979 A * 7/1998 Burleson ..... E21B 43/116 166/297
5,813,480 A 9/1998 Zaleski, Jr. et al.
5,823,266 A 10/1998 Burleson et al.
5,826,654 A 10/1998 Adnan et al.
5,957,209 A 9/1999 Burleson et al.
5,964,294 A 10/1999 Edwards et al.
5,992,523 A 11/1999 Burleson et al.
6,012,015 A 1/2000 Tubel
6,021,377 A 2/2000 Dubinsky et al.
6,068,394 A 5/2000 Dublin, Jr.
6,078,867 A 6/2000 Plumb et al.
6,098,716 A 8/2000 Hromas et al.
6,135,252 A 10/2000 Knotts
6,173,779 B1 1/2001 Smith
6,216,533 B1 4/2001 Woloson et al.
6,230,101 B1 5/2001 Wallis
6,283,214 B1 9/2001 Guinot et al.
6,308,809 B1 10/2001 Reid et al.
6,371,541 B1 4/2002 Pedersen
6,394,241 B1 5/2002 Desjardins et al.
6,397,752 B1 6/2002 Yang et al.
6,408,953 B1 6/2002 Goldman et al.
6,412,415 B1 7/2002 Kothari et al.
6,412,614 B1 7/2002 Lagrange et al.
6,450,022 B1 9/2002 Brewer
6,454,012 B1 9/2002 Reid
6,457,570 B2 10/2002 Reid et al.
6,484,801 B2 11/2002 Brewer et al.
6,543,538 B2 4/2003 Tolman et al.
6,550,322 B2 4/2003 Sweetland et al.
6,595,290 B2 7/2003 George et al.
6,672,405 B2 1/2004 Tolman et al.
6,674,432 B2 1/2004 Kennon et al.
6,679,323 B2 1/2004 Vargervik et al.
6,679,327 B2 1/2004 Sloan et al.
6,684,949 B1 2/2004 Gabler et al.
6,684,954 B2 2/2004 George
6,708,761 B2 3/2004 George et al.
6,810,370 B1 10/2004 Watts, III
6,826,483 B1 11/2004 Anderson et al.
6,832,159 B2 12/2004 Smits et al.
6,842,725 B1 1/2005 Sarda
6,868,920 B2 3/2005 Hoteit et al.
6,896,059 B2 5/2005 Brooks et al.
7,000,699 B2 2/2006 Yang et al.
7,006,959 B1 2/2006 Huh et al.
7,044,219 B2 5/2006 Mason et al.
7,114,564 B2 10/2006 Parrott et al.
7,121,340 B2 10/2006 Grove et al.
7,139,689 B2 11/2006 Huang
7,147,088 B2 12/2006 Reid et al.
7,165,612 B2 1/2007 McLaughlin
7,178,608 B2 2/2007 Mayes et al.
7,195,066 B2 3/2007 Sukup et al.
7,234,517 B2 6/2007 Streich et al.
7,246,659 B2 7/2007 Fripp et al.
7,260,508 B2 8/2007 Lim et al.
7,278,480 B2 10/2007 Longfield et al.
7,387,160 B2 6/2008 O'Shaughnessy et al.
7,387,162 B2 6/2008 Mooney, Jr. et al.
7,503,403 B2 3/2009 Jogi et al.
7,509,245 B2 3/2009 Siebrits et al.
7,533,722 B2 5/2009 George et al.
7,600,568 B2 10/2009 Ross et al.
7,603,264 B2 10/2009 Zamora et al.
7,640,986 B2 1/2010 Behrmann et al.
7,721,650 B2 5/2010 Barton et al.
7,721,820 B2 5/2010 Hill et al.
7,762,331 B2 7/2010 Goodman et al.
7,770,662 B2 8/2010 Harvey et al.
7,784,532 B2 8/2010 Sevre et al.
7,806,035 B2 10/2010 Kaiser et al.
8,126,646 B2 2/2012 Grove et al.
8,136,608 B2 3/2012 Goodman
8,181,718 B2 5/2012 Burleson et al.
8,186,259 B2 5/2012 Burleson et al.
8,393,393 B2 3/2013 Rodgers et al.
8,397,800 B2 3/2013 Rodgers et al.
8,397,814 B2 3/2013 Rodgers et al.
8,408,286 B2 4/2013 Rodgers et al.
8,714,251 B2 5/2014 Glenn et al.
8,714,252 B2 5/2014 Glenn et al.
8,875,796 B2 * 11/2014 Hales ..... E21B 43/11 166/378
8,881,816 B2 * 11/2014 Glenn ..... E21B 17/07 166/297
8,978,749 B2 3/2015 Rodgers et al.
9,091,152 B2 * 7/2015 Rodgers ..... E21B 43/1195

(56) References Cited

U.S. PATENT DOCUMENTS

| | | | | |
|---|---|---|---|---|
| 9,206,675 | B2 * | 12/2015 | Hales | E21B 43/11 |
| 9,328,567 | B2 * | 5/2016 | Evans | E21B 17/07 |
| 2002/0121134 | A1 | 9/2002 | Sweetland et al. | |
| 2003/0062169 | A1 | 4/2003 | Marshall | |
| 2003/0089497 | A1 | 5/2003 | George et al. | |
| 2003/0150646 | A1 | 8/2003 | Brooks et al. | |
| 2004/0045351 | A1 | 3/2004 | Skinner | |
| 2004/0104029 | A1 | 6/2004 | Martin | |
| 2004/0140090 | A1 | 7/2004 | Mason et al. | |
| 2006/0048940 | A1 | 3/2006 | Hromas et al. | |
| 2006/0070734 | A1 | 4/2006 | Zillinger et al. | |
| 2006/0118297 | A1 | 6/2006 | Finci et al. | |
| 2006/0243453 | A1 | 11/2006 | McKee | |
| 2007/0162235 | A1 | 7/2007 | Zhan et al. | |
| 2007/0193740 | A1 | 8/2007 | Quint | |
| 2007/0214990 | A1 | 9/2007 | Barkley et al. | |
| 2007/0267201 | A1 | 11/2007 | Brezinski et al. | |
| 2007/0283751 | A1 | 12/2007 | Van Der Spek | |
| 2008/0041597 | A1 | 2/2008 | Fisher et al. | |
| 2008/0125335 | A1 | 5/2008 | Bhavsar | |
| 2008/0149338 | A1 | 6/2008 | Goodman et al. | |
| 2008/0202325 | A1 | 8/2008 | Bertoja et al. | |
| 2008/0216554 | A1 | 9/2008 | McKee | |
| 2008/0245255 | A1 | 10/2008 | Barton et al. | |
| 2008/0262810 | A1 | 10/2008 | Moran et al. | |
| 2008/0314582 | A1 | 12/2008 | Belani et al. | |
| 2009/0013775 | A1 | 1/2009 | Bogath et al. | |
| 2009/0071645 | A1 | 3/2009 | Kenison et al. | |
| 2009/0084535 | A1 | 4/2009 | Bertoja et al. | |
| 2009/0151588 | A1 | 6/2009 | Burleson et al. | |
| 2009/0151589 | A1 | 6/2009 | Henderson et al. | |
| 2009/0159284 | A1 | 6/2009 | Goodman | |
| 2009/0168606 | A1 | 7/2009 | Lerche et al. | |
| 2009/0182541 | A1 | 7/2009 | Crick et al. | |
| 2009/0223400 | A1 | 9/2009 | Hill et al. | |
| 2009/0272529 | A1 | 11/2009 | Crawford | |
| 2009/0272839 | A1 | 11/2009 | Clingman | |
| 2009/0276156 | A1 | 11/2009 | Kragas et al. | |
| 2009/0294122 | A1 | 12/2009 | Hansen et al. | |
| 2010/0000789 | A1 | 1/2010 | Barton et al. | |
| 2010/0011943 | A1 | 1/2010 | Quinn et al. | |
| 2010/0037793 | A1 | 2/2010 | Lee et al. | |
| 2010/0051265 | A1 | 3/2010 | Hurst et al. | |
| 2010/0085210 | A1 | 4/2010 | Bonavides et al. | |
| 2010/0132939 | A1 | 6/2010 | Rodgers | |
| 2010/0133004 | A1 | 6/2010 | Burleson et al. | |
| 2010/0147519 | A1 | 6/2010 | Goodman | |
| 2010/0230105 | A1 | 9/2010 | Vaynshteyn | |
| 2011/0120695 | A1 | 5/2011 | Burleson et al. | |
| 2011/0162843 | A1 | 7/2011 | Maier et al. | |
| 2012/0085539 | A1 | 4/2012 | Tonnessen et al. | |
| 2012/0152519 | A1 | 6/2012 | Rodgers et al. | |
| 2012/0152614 | A1 | 6/2012 | Rodgers et al. | |
| 2012/0152615 | A1 * | 6/2012 | Rodgers | E21B 43/1195 175/2 |
| 2012/0152616 | A1 | 6/2012 | Rodgers et al. | |
| 2012/0158388 | A1 * | 6/2012 | Rodgers | G05B 17/02 703/10 |
| 2012/0273201 | A1 | 11/2012 | Glenn et al. | |
| 2012/0318508 | A1 | 12/2012 | Glenn et al. | |
| 2013/0048375 | A1 | 2/2013 | Rodgers et al. | |
| 2013/0048376 | A1 | 2/2013 | Rodgers et al. | |
| 2013/0248184 | A1 | 9/2013 | Glenn et al. | |
| 2014/0076564 | A1 * | 3/2014 | Rodgers | E21B 43/116 166/298 |
| 2014/0076631 | A1 | 3/2014 | Rodgers et al. | |
| 2015/0083438 | A1 * | 3/2015 | Tao | E21B 31/06 166/381 |

FOREIGN PATENT DOCUMENTS

| | | | |
|---|---|---|---|
| WO | 2007056121 | A1 | 5/2007 |
| WO | 2012082143 | A1 | 6/2012 |
| WO | 2012082186 | A1 | 6/2012 |
| WO | 2012082195 | A1 | 6/2012 |
| WO | 2012148429 | A1 | 11/2012 |
| WO | 2014003699 | A2 | 1/2014 |
| WO | 2014046655 | A1 | 3/2014 |
| WO | 2014046656 | A1 | 3/2014 |

OTHER PUBLICATIONS

Burleson, John D., et al., PCT Application entitled, "Modeling Shock Produced by Well Perforating," filed Dec. 17, 2010, Int'l Application No. PCT/US2010/061104.

Rodgers, John P., et al. PCT Application entitled, "Perforation Gun String Energy Propagation Management System and Methods", filed Sep. 19, 2012, Int'l Application No. PCT/US12/56165.

Rodgers, John P., et al., PCT Application entitled, "Perforation Gun String Energy Propagation Management with Tuned Mass Damper", filed Sep. 19, 2012, Int'l Application No. PCT/US12/56164.

Martinez, Samuel, et al., PCT Application entitled, "Shock Attenuator for Gun System", filed Apr. 3, 2012, Int'l Application No. PCT/US12/32004.

Glenn, Timothy S., et al., Patent Application entitled, "Shock Load Mitigation in a Downhole Perforation Tool Assembly", filed May 15, 2013, U.S. Appl. No. 13/895,032.

Office Action Restriction dated Jul. 30, 2009, U.S. Appl. No. 11/957,541, filed Dec. 17, 2007.

Office Action dated Sep. 8, 2009, U.S. Appl. No. 11/957,541, filed Dec. 17, 2007.

Office Action dated Feb. 2, 2010, U.S. Appl. No. 11/957,541, filed Dec. 17, 2007.

Office Action dated Jul. 15, 2010, U.S. Appl. No. 11/957,541, filed Dec. 17, 2007.

Office Action dated Nov. 22, 2010, U.S. Appl. No. 11/957,541, filed Dec. 17, 2007.

Notice of Allowance dated Feb. 7, 2011, U.S. Appl. No. 11/957,541, filed Dec. 17, 2007.

Office Action dated May 4, 2011, U.S. Appl. No. 11/957,541, filed Dec. 17, 2007.

Final Office Action dated Oct. 24, 2011, U.S. Appl. No. 11/957,541, filed Dec. 17, 2007.

Notice of Allowance dated Jan. 27, 2012, U.S. Appl. No. 11/957,541, filed Dec. 17, 2007.

Office Action dated Apr. 21, 2011, U.S. Appl. No. 13/008,075, filed Jan. 18, 2011.

Final Office Action dated Oct. 24, 2011, U.S. Appl. No. 13/008,075, filed Jan. 18, 2011.

Advisory Action dated Jan. 17, 2012, U.S. Appl. No. 13/008,075, filed Jan. 18, 2011.

Notice of Allowance dated Jan. 25, 2012, U.S. Appl. No. 13/008,075, filed Jan. 18, 2011.

Office Action dated Jun. 13, 2012, U.S. Appl. No. 13/377,148, filed Dec. 8, 2011.

Final Office Action dated Jan. 18, 2013, U.S. Appl. No. 13/377,148, filed Dec. 8, 2011.

Notice of Allowance dated Apr. 2, 2013, U.S. Appl. No. 13/377,148, filed Dec. 8, 2011.

Restriction Requirement dated Jan. 31, 2013, U.S. Appl. No. 13/594,776, filed Aug. 25, 2012.

Office Action dated Mar. 26, 2013, U.S. Appl. No. 13/594,776, filed Aug. 25, 2012.

Notice of Allowance dated Jul. 11, 2013, U.S. Appl. No. 13/594,776, filed Aug. 25, 2012.

Office Action dated Jan. 27, 2012, U.S. Appl. No. 13/210,303, filed Aug. 15, 2011.

Final Office Action dated Aug. 2, 2012, U.S. Appl. No. 13/210,303, filed Aug. 15, 2011.

Office Action dated Apr. 4, 2013, U.S. Appl. No. 13/210,303, filed Aug. 15, 2011.

Office Action dated Apr. 10, 2012, U.S. Appl. No. 13/325,726, filed Dec. 14, 2011.

Final Office Action dated Jul. 26, 2012, U.S. Appl. No. 13/325,726, filed Dec. 14, 2011.

(56) References Cited

OTHER PUBLICATIONS

Office Action dated Oct. 1, 2012, U.S. Appl. No. 13/325,726, filed Dec. 14, 2011.
Notice of Allowance dated Jan. 23, 2013, U.S. Appl. No. 13/325,726, filed Dec. 14, 2011.
Office Action dated Jun. 29, 2012, U.S. Appl. No. 13/325,866, filed Dec. 14, 2011.
Final Office Action dated Oct. 23, 2012, U.S. Appl. No. 13/325,866, filed Dec. 14, 2011.
Notice of Allowance dated Jan. 24, 2013, U.S. Appl. No. 13/325,866, filed Dec. 14, 2011.
Office Action dated Sep. 6, 2012, U.S. Appl. No. 13/495,035, filed Jun. 13, 2012.
Final Office Action dated Dec. 14, 2012, U.S. Appl. No. 13/495,035.
Notice of Allowance dated Feb. 15, 2013, U.S. Appl. No. 13/495,035.
Office Action dated Jun. 6, 2012, U.S. Appl. No. 13/325,909, filed Dec. 14, 2011.
Final Office Action dated Nov. 19, 2012, U.S. Appl. No. 13/325,909, filed Dec. 14, 2011.
Notice of Allowance dated Feb. 1, 2013, U.S. Appl. No. 13/325,909, filed Dec. 14, 2011.
Office Action dated Dec. 18, 2012, U.S. Appl. No. 13/533,600, filed Jun. 26, 2012.
Final Office Action dated Jun. 20, 2013, U.S. Appl. No. 13/533,600, filed Jun. 26, 2012.
Office Action dated Feb. 24, 2012, U.S. Appl. No. 13/304,075, filed Nov. 23, 2011.
Office Action dated Dec. 12, 2012, U.S. Appl. No. 13/493,327, filed Jun. 11, 2012.
Final Office Action dated Jun. 11, 2013, U.S. Appl. No. 13/493,327, filed Jun. 11, 2012.
"PulsFrac™ Validation: Owen/HTH Surface Block Test," John F. Schatz Research and Consulting, Inc., 2004.
Regalbuto, J.A. et al., "Computer Codes for Oilwell-Perforator Design," Halliburton Explosive Products Center, SPE Drilling & Completion, Sep. 1997, p. 188-195, Halliburton Energy Services, Inc.
Rudshaug, Terje, et al., "NETool™ a toolbox for Improved Reservoir Management," FORCE AWTC Seminar—Advanced Wells—Lessons Learned (application experience) and Future Directions/Opportunities, Apr. 21-22, 2004, DPT US, Inc.
Schatz, J.F. et al., "High-Speed Downhole Memory Recorder and Software Used to Design and Confirm Perforating/Propellant Behavior and Formation Fracturing," Society of Petroleum Engineers, Inc., 1999.
Schatz, J.F. et al., "High-Speed Pressure and Accelerometer Measurements Characterize Dynamic Behavior During Perforating Events in Deepwater Gulf of Mexico," SPE 90042, Society of Petroleum Engineers, 2004.
Schatz, John, "The Role of Compressibility in PulsFrac® Software," John F. Schatz Research and Consulting, Inc., Aug. 22, 2007.
"Series 200 High Shock, High Speed Pressure and Acceleration Gauge", IES, Instrumentation and Engineering Services Inc., Aug. 2004, U.S.A.
"Series 300 Gauge," http://www.iesrecorderes.com/oilwell.htm (last visited Sep. 1, 2010), IES Recorders—Oil Well.
"Series 300 High Shock, High Speed Pressure Gauge", Instrumentation and Engineering Services Inc., Feb. 2010, Navarre, FL, U.S.A.
Shepherd, Joseph E., "Structural Response of Piping to Internal Gas Detonation," Proceedings of PVP2006-ICPVT-11, 2006 ASME Pressure Vessels and Piping Division Conference, Jul. 23-27, 2006, Vancouver BC, Canada.
"ShockPro Shockload Evaluation Service—Engineer Perforated Completions to Evaluate the Mechanical Integrity of All System Components," Wireline and Perforating Services, Halliburton Energy Services, Inc.
"ShockPro Shockload Evaluation Service" Perforating Solutions 5-125, Halliburton Energy Services, Inc.
"Simulation Software for EquiFlow® ICD Completions," Advanced Completions, HO7010, Halliburton, Sep. 2009.
"SXVA Explosively Initiated Vertical Shock Absorber", product paper 06-WT-066, Schlumberger, 2007.
"WEM—Well Evaluation Model," P.E. Moseley & Associates, Inc., Houston, TX U.S.A.
Rodgers, John P., et al., Patent Application entitled, "Perforation Gun String Energy Propagation Management with Tuned Mass Damper", filed Sep. 5, 2013, U.S. Appl. No. 14/003,234.
Rodgers, John P., et al., Patent Application entitled, "Perforation Gun String Energy Propagation Management with Tuned Mass Damper", filed Sep. 18, 2013, U.S. Appl. No. 14/031,034.
Martinez, Samuel, et al., Patent Application entitled, "Shock Attenuator for Gun System", filed Mar. 4, 2013, U.S. Appl. No. 13/820,748.
Notice of Allowance dated Sep. 26, 2013, U.S. Appl. No. 13/377,148, filed Dec. 8, 2011.
Notice of Allowance dated Oct. 2, 2013, U.S. Appl. No. 13/594,776, filed Aug. 25, 2012.
Office Action dated Sep. 30, 2013, U.S. Appl. No. 13/895,032, filed May 15, 2013.
Final Office Action dated Sep. 13, 2013, U.S. Appl. No. 13/210,303, filed Aug. 15, 2011 (Smith IP).
Office Action dated Oct. 1, 2012, U.S. Appl. No. 13/325,866, filed Dec. 14, 2011, (Smith IP).
Foreign Communication From a Related Counterpart Application—International Search Report and Written Opinion, PCT/US2011/034690, Oct. 27, 2011.
Foreign Communication From a Related Counterpart Application—International Search Report and Written Opinion, PCT/US2010/061104, Jul. 28, 2011.
Foreign Communication From a Related Counterpart Application—International Search Report and Written Opinion, PCT/US2010/061102, Jul. 28, 2011.
Foreign Communication From a Related Counterpart Application—International Search Report and Written Opinion, PCT/US2011/029412, Nov. 22, 2011.
Foreign Communication From a Related Counterpart Application—International Search Report and Written Opinion, PCT/US2011/046955, Dec. 27, 2011 (Smith IP).
Foreign Communication From a Related Counterpart Application—International Search Report and Written Opinion, PCT/US2011/061107, Jul. 28, 2011.
Foreign Communication From a Related Counterpart Application—International Search Report and Written Opinion, PCT/US2011/050395, Feb. 17, 2012 (Smith IP).
Foreign Communication From a Related Counterpart Application—International Search Report and Written Opinion, PCT/US2011/049882, Feb. 20, 2012 (Smith IP).
Foreign Communication From a Related Counterpart Application—International Search Report and Written Opinion, PCT/US2011/050401, Feb. 9, 2012 (Smith IP).
Foreign Communication from a Related Counterpart Application, International Search Report and Written Opinion dated Apr. 10, 2013, International Application PCT/US12/56165 filed on Sep. 19, 2012.
Foreign Communication from a Related Counterpart Application, International Search Report and Written Opinion dated Apr. 5, 2013, International Application PCT/US12/56164 filed Sep. 19, 2012.
"2010 International Perforating Symposium", Agenda, dated May 6-7, 2010 2 pages.
"Accelerometer Wire Termination," IES, AN106.
Ager, Scott, IES "Fast Speed Gages," Power Point Presentation; Mar. 2, 2009, Navarre, FL, U.S.A.
Ager, Scott, "IES Housing and High Shock Considerations," Power Point Presentation.
Ager, Scott, "IES Introduction," Power Point Presentation, IES, U.S.A.
Ager, Scott, "IES Recorder Buildup," Power Point Presentation, U.S.A.
Ager, Scott, "Model 64 and 67 Buildup," Power Point Presentation, Oct. 17, 2006, U.S.A.

(56) References Cited

OTHER PUBLICATIONS

Ager, Scott, "IES Sensor Discussion," Power Point Presentation. U.S.A.
"Analog Recorder Test Example," http://www.iesrecorders.com/highschock.htm (last visited Sep. 1, 2010), IES Recorders-Highshock.
Ansah, Joseph et al., "Advances in Well Completion Design: A New 3D Finite-Element Wellbore Inflow Model for Optimizing Performance of Perforated Completions," Society of Petroleum Engineers, 2002.
"AutoLatch™ Release Gun Connector", Special Applications 6-7, Halliburton.
"Battery Packaging for High Shock", IES, AN102.
Baumann, Carlos, et al., "Perforating Wellbore Dynamics and Gunshock in Deepwater TCP Operations," Product Information Presentation, IPS-10-018, Schlumberger Reservoir Completions.
Blakeborough, A. et al., "Novel Load Cell for Measuring Axial Force, Shear Force, and Bending Movement in Large-scale Structural Experiments," Experimental Mechanics, vol. 42, No. 1, p. 115-122, Mar. 2002.
"Body Lock Ring", Mechanical Downhole Technology Transfer, Halliburton.
Bruyere, Frederic et al., "New Practices to Enhance Perforating Results", Oilfield Review, p. 18-35, Autumn 2006.
Canal, et al., "Predicting Pressure Behavior and Dynamic Shock Loads on Completion Hardware During Perforating," May 3-6, 2010.
"Casing Differential in PulsFrac™ Calculations," John F. Schatz Research and Consulting, Inc. 2004.
Cuthill, D.A. et al., "A New Technique for Rapid Estimation of Fracture Closure Stress When Using Propellants," SPE/ISRM 78171, Society of Petroleum Engineers, 2002.
Dobrilovic, Mario et al., "Measurements of Shock Wave Force in Shock Tube with Indirect Methods," Rudarsko-geolosko-naftni zbornik, vol. 17, 2005. University of Zagreb; Zagreb, Croatia.
"Downhole Mechanical Shock Absorber". Preliminary Report—patent and prior art search results, dated Jul. 8, 2010, Starboard Innovations, LLC.
"Ecrin Dynamic Flow Analysis Platform," http://www.essca.com/en/ecrin_en.asp (last visited Oct. 28, 2010) ESSCA, 2009.
"Electronic Initiation System," Special Devices, Inc., http://www.specialdevices.com/mining.htm (last visited May 18, 2011) Mesa, AZ, U.S.A.
"Fast Gauge Recorder," Perforating Solutions 5-110, Halliburton.
Furui, Kenji, "A Comprehensive Skin Factor Model for Well Completions Based on Finite Element Simulations," University of Texas at Austin, 2004.
Grove, B. et al., "Explosion-induced damage to oilwell perforating gun carriers," Structures Under Shock and Impact IX, WIT Transactions on the Built Environment, vol. 87, p. 165-176, WIT Press, 2006.
Grove, B. et al., "New Effective Stress Law for Predicting Perforation Depth at Downhole Conditions," SPE 111778, Society of Petroleum Engineers, 2008.
"Integrated Production Modeling Brochure," Petroleum Experts Ltd., 2008.
Jin, Quiankun et al., "3D Numerical Simulations of Penetrations of Oil-Well Perforator into Concrete Targets," 7th International LS-DYNA Users Conference, Beijing Engineering Software Technology Co., Ltd., Beijing, China.
Li, W et al., "The effect of annular multi-point initiation on the formation and penetration of an explosively formed penetrator," International Journal of Impact Engineering, 2009, doi:10.1016/j.ijimpeng.2009.08.008.
Murilo, Sergio et al., "Optimization and Automation of Modeling of Florw in Perforated Oil Wells," Virtual Product Development Conference, 2004. MSC Software, Huntingon Beach, California, U.S.A.
Ouyang, Liang-Biao et al., "Case Studies for Improving Completion Design Through Comprehensive Well-Performance Modeling," SPE 104078, Society of Petroleum Engineers, 2006.
Ouyang, Liang-Biao et al., "Uncertainty Assessment on Well-Performance Prediction for an Oil Producer Equipped With Selected Completions," SPE 106966, Society of Petroleum Engineers, 2007.
"Pert Breakdown, Fracturing, and Cleanup in PulsFrac®," John F. Schatz Research and Consulting, Inc., May 2, 2007.
"Petroleum Exploration & Production Software, Training & Consulting," v4.12-B, KAPPA Engineering, Jan. 2010.
"Positioning Strain Gages to Monitor Bending, Axial, Shear, and Torsional Loads," Strain Gages E.
"Problems in High-shock Management," Endevco, MEGGITT.
Proett, M.A. et al., "Productivity Optimization of Oil Wells Using a New 3D Finit-Element Wellbore Inflow Model and Artificial Neural Network," Halliburton Energy Services, Inc.
"PulsFrac™ Summary Technical Description", John F. Schatz Research and Consulting, Inc., 2004.
Office Action dated Mar. 21, 2014, U.S. Appl. No. 13/210,303, filed Aug. 15, 2011, (Smith IP).
Office Action dated May 16, 2014, U.S. Appl. No. 13/533,600, filed Jun. 26, 2012, (Smith IP).
Final Office Action dated Mar. 12, 2014, U.S. Appl. No. 13/304,075, filed Nov. 23, 2011, (Smith IP).
Final Office Action dated May 19, 2014, U.S. Appl. No. 13/493,327, filed Jun. 11, 2012, (Smith IP).
Foreign Communication From a Related Counterpart Application—International Preliminary Report on Patentability, PCT/US2011/034690, Oct. 29, 2013.
Foreign Communication from a Related Counterpart Application, International Search dated Jan. 21, 2014, International Application PCT/US12/32004 filed Apr. 3, 2012.
Foreign Communication from a Related Counterpart Application, Chapter II Demand, Article 34 Amendments and Arguments dated Apr. 10, 2014, International Application PCT/US12/32004 filed Apr. 3, 2012.
Foreign Communication from a Related Counterpart Application, Notification of Receipt of Demand by Competent International Preliminary Examining Authority dated Jan. 21, 2014, International Application PCT/US12/32004 filed Apr. 3, 2012.
Notice of Allowance dated Feb. 20, 2014, U.S. Appl. No. 13/895,032, filed May 15, 2013.
FAIPP Pre-Interview Communication dated Jul. 23, 2014, U.S. Appl. No. 14/003,243, filed Sep. 5, 2013.
Office Action dated Jul. 3, 2014, U.S. Appl. No. 13/210,303, filed Aug. 15, 2011, (Smith IP).
Advisory Action dated Jul. 10, 2014, U.S. Appl. No. 13/304,075, filed Nov. 23, 2011, (Smith IP).
Advisory Action dated Jul. 24, 2014, U.S. Appl. No. 13/493,327, filed Jun. 11, 2012, (Smith IP).
First Action Interview Pilot Program Pre-Interview Communication Issued in Corresponding U.S. Appl. No. 14/031,034, Dated Oct. 2, 2015 (5 Pages).
Notice of Allowance dated Jan. 23, 2014, U.S. Appl. No. 13/377,148, filed Dec. 8, 2011.
Notice of Allowance dated Jan. 23, 2014, U.S. Appl. No. 13/594,776, filed Aug. 25, 2012.
Advisory Action dated Nov. 27, 2013, U.S. Appl. No. 13/210,303, filed Aug. 15, 2011, (Smith IP).
Office Action dated Nov. 7, 2013, U.S. Appl. No. 13/304,075, filed Nov. 23, 2011, (Smith IP).

* cited by examiner

PERFORATION GUN STRING ENERGY PROPAGATION MANAGEMENT SYSTEM AND METHODS

CROSS-REFERENCE TO RELATED APPLICATIONS

This application is a 35 U.S.C. 371 National Stage of and claims priority to International Application No. PCT/US12/56165, filed Sep. 19, 2012, entitled "PERFORATION GUN STRING ENERGY PROPAGATION MANAGEMENT SYSTEM AND METHODS," which is incorporated herein by reference in its entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are drilled into the earth for a variety of purposes including tapping into hydrocarbon bearing formations to extract the hydrocarbons for use as fuel, lubricants, chemical production, and other purposes. When a wellbore has been completed, a metal tubular casing may be placed and cemented in the wellbore. Thereafter, a perforation tool assembly may be run into the casing, and one or more perforation guns in the perforation tool assembly may be activated and/or fired to perforate the casing and/or the formation to promote production of hydrocarbons from selected formations. Perforation guns may comprise one or more explosive charges that may be selectively activated, the detonation of the explosive charges desirably piercing the casing and penetrating at least partly into the formation proximate to the wellbore.

SUMMARY

In an embodiment, a perforation tool assembly is disclosed. The perforation tool assembly comprises a tool string connector, a perforation gun coupled to the tool string connector, and a structure configured to absorb mechanical energy released by firing one or more perforation guns. The coupling is configured to provide a limited range of motion of the tool string connector relative to the perforation gun. The tool string connector and the perforation gun retain the structure configured to absorb mechanical energy.

In an embodiment, a perforation tool assembly is disclosed. The perforation tool assembly comprises a tool string connector having a latch component, a perforation gun having a latch mate that is configured to engage the latch component to couple the perforation gun to the tool string connector, and a mechanical energy absorber configured to absorb mechanical energy released by firing one or more perforation guns. The tool string connector and the perforating gun are configured to provide a limited range of motion of the tool string connector relative to the perforation gun when the mechanical energy absorber is not located between the tool string connector and the perforation gun. The mechanical energy absorber is retained by the tool string connector and the perforation gun.

In an embodiment, a method of perforating a casing sting in a wellbore is disclosed. The method comprises placing a perforation gun in a wellbore, placing a mechanical energy propagation management device between the perforation gun and a tool string connector, and coupling the perforation gun to the tool string connector, wherein the perforation gun and the tool string connector are configured to move relative to each other within a limited range of motion.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
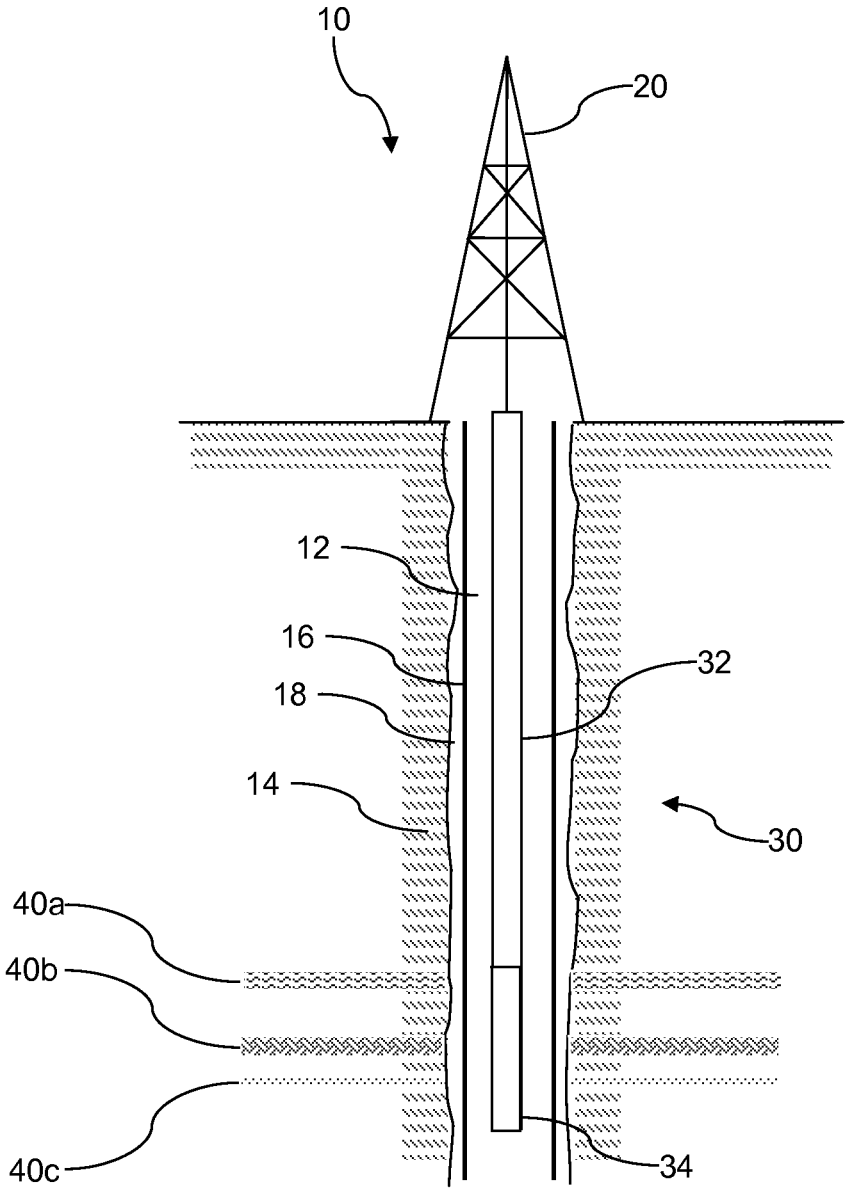
FIG. 1 is an illustration of a wellbore and workstring according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

In recent downhole wellbore servicing practice, perforation tool assemblies have featured increasing numbers of explosive charges, and the overall length of the perforation tool assemblies has increased. Along with this evolution, new problems have been experienced during wellbore servicing operations. These problems may include perforation tool assemblies that separate, leaving a portion of the perforation tool assembly in the wellbore when the workstring is removed from the wellbore after firing the perforation guns. The perforation tool assembly and/or workstring may buckle, deform, or yield. The perforation tool assembly and/or workstring may fail in compression or in a corkscrew buckling mode. In some failures, the perforation tool assembly and/or workstring may become stuck in the wellbore. A packer in the workstring and/or tubing above the perforation tool assembly may be damaged. Yet other failure modes may be experienced. These problems may entail time consuming and expensive fishing operations to capture and retrieve portions of the perforation tool assembly that parted. These problems may delay placing the wellbore on production, thereby incurring financial losses. In a worst case scenario, the wellbore may be lost entirely.

It is a teaching of the present disclosure that, in some cases, the cause of these problems experienced during the course of perforating the wellbore may be ascribed to an accumulation of energy in a shock wave, a shock wave peak, and/or a shock load that propagates in a tool body of the perforation tool assembly. This may be referred to as an accumulation of the shock load in a tool body of the perforation tool assembly. As used herein, the term shock load may have a variety of meanings. One meaning is to refer to a mechanical stress caused by detonation of one or more explosive charges that is applied as a force on the perforation tool assembly and/or workstring. To some extent, most of the shock load may comprise a force directed parallel to an axis of the perforation tool assembly and/or workstring. This stress may be applied both downhole and uphole parallel to the axis of the perforation tool assembly and/or workstring. It is understood that in some circumstances, the perforation tool assembly and/or workstring may be curved or arced over one or more segments. In this circumstance, the expression "parallel to an axis" is understood to mean tangent to the arc of the perforation tool assembly and/or workstring at the point of interest. Notwithstanding, a portion of the stress may be directed in other directions such as radial to the perforation tool assembly and/or workstring.

As explosive charges in the perforation guns of the perforation tool assembly are detonated, some of the energy released by the detonation propagates in the tool body of the perforation tool assembly, parallel to the axis of the perforation tool assembly. If the activation of the explosive charges progresses parallel to the axis of the perforation gun assembly at about the same speed that the shock wave propagates in the tool body, the energy in the shock wave can accumulate and/or build with each successive detonation, increasing the shock load. In an embodiment, the shock wave may travel down the perforation tool assembly in a compression wave, reflect off the end of the perforation tool assembly, and travel back up the perforation tool assembly as a tensile wave. Some failure modes may be associated with compression waves, and other failure modes may be associated with tensile waves. While descriptions herein refer to a top to bottom detonation sequence of explosive charges and/or perforation guns, it is understood that other detonation sequences are consistent with the present disclosure.

Under some circumstances, it may be desirable to create a dynamic underbalance condition in the wellbore immediately following charge detonation. The dynamic underbalance is a transient pressure condition in the wellbore during the perforating operation that allows the wellbore to be maintained at an overbalanced pressure condition prior to perforating. The dynamic underbalance condition can be created using hollow carrier type perforating guns, which consists of an outer tubular member that serves as a pressure barrier to separate the explosive train from pressurized wellbore fluids prior to perforating. The interior of the perforating guns contains the shaped charges, the detonating cord and the charge holder tubes. The remaining volume inside the perforating guns consists of air at essentially atmospheric pressure.

Upon detonation of the shaped charges, the interior pressure rises to tens of thousands of psi within microseconds. The detonation gases then exit the perforating guns through the holes created by the shaped charge jets and rapidly expand to lower pressure as they are expelled from the perforating guns. The interior of the perforating guns becomes a substantially empty chamber which rapidly fills with the surrounding wellbore fluid. In some cases, an underbalance subassembly may be incorporated into a perforation gun string that carries no charges itself but which is designed to suddenly open to contribute to the dynamic underbalance condition immediately following charge detonation. Further, as there is a communication path via the perforation tunnels between the wellbore and reservoir, formation fluids rush from their region of high pressure in the reservoir through the perforation tunnels and into the region of low pressure within the wellbore and the empty perforating guns. All this action takes place within milliseconds of gun detonation. In an embodiment, the dynamic underbalance may contribute to the forces in the perforation tool assembly and/or the shock load in the perforation tool assembly.

A method and apparatus for mitigating a shock load in a perforation tool assembly is taught herein. In an embodiment, the shock load may be managed in one or more ways. The shock wave may have a portion of its energy frequency shifted to a different frequency by one or more components in the perforation tool assembly. For example, a tool string connector and a perforation gun may be assembled with a nonlinear spring located between them. The tool string may be coupled to the perforation gun so as to provide a limited range of relative motion, for example axial motion of the perforation gun relative to the tool string connector. As the shock wave propagates from the perforation gun to the tool string connector, the nonlinear spring transforms a portion of the shock wave energy to higher order harmonic frequencies.

The shock wave may have a portion of its energy absorbed by one or more components in the perforation tool assembly. For example, a tool string connector and a perforation gun may be assembled with a mechanical energy absorbing structure located between them. The tool string may be coupled to the perforation gun so as to provide a limited range of relative motion between the two components, for example axial motion (e.g., free motion) of the perforation gun relative to the tool string connector. When the shock load propagates from the perforation gun to the tool string connector, the perforation gun moves with reference to the tool string connector, and the mechanical energy absorber disposed between the perforation gun and the tool string connector may be configured to absorb at least a portion of the energy. For example, energy from the shock load is consumed in crushing a honeycomb structure or crushing a grooved or fluted ductile metal washer. As another example, the structures may comprise one or more energy mass absorbers where a mass is suspended within a segment of tubing with energy absorbing elements and/or spring members supporting the mass on either end. The mass absorber may be disposed between guns of a multi-gun system to absorb and/or disrupt the transmission of the shock waves along the string.

The wellbore and the perforation gun string may be modeled, and a perforation job may be simulated based on the wellbore model and the perforation gun string model. The results of the simulation may be analyzed to adapt the design of the nonlinear spring and/or the mechanical energy absorber to more desirably manage the shock load propagation in the perforation gun string. For more details of modeling shock loads, see U.S. patent application Ser. No. 13/210,303, entitled "Modeling Shock Produced by Well Perforation," by John Rodgers, et al., and International Application Serial No. PCT/US10/61104, filed 17 Dec. 2010, entitled "Modeling Shock Produced by Well Perforation," by John Rodgers, et al., which are hereby incorporated by reference in their entirety.

Unless otherwise specified, any use of any form of the terms "connect," "engage," "couple," "attach," or any other term describing an interaction between elements is not meant to limit the interaction to direct interaction between the elements and also may include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Turning now to FIG. 1, a wellbore servicing system 10 is described. The system 10 comprises servicing rig 20 that extends over and around a wellbore 12 that penetrates a subterranean formation 14 for the purpose of recovering hydrocarbons from a first production zone 40*a*, a second production zone 40*b*, and/or a third production zone 40*c*. The wellbore 12 may be drilled into the subterranean formation 14 using any suitable drilling technique. While shown as extending vertically from the surface in FIG. 1, in some embodiments the wellbore 12 may be deviated, horizontal, and/or curved over at least some portions of the wellbore 12. For example, in an embodiment, the wellbore 12, or a lateral wellbore drilled off of the wellbore 12, may deviate and remain within one of the production zones 40. The wellbore 12 may be cased, open hole, contain tubing, and may generally comprise a hole in the ground having a variety of shapes and/or geometries as is known to those of skill in the art. In an embodiment, a casing 16 may be placed in the wellbore 12 and secured at least in part by cement 18.

The servicing rig 20 may be one of a drilling rig, a completion rig, a workover rig, or other mast structure and supports a workstring 30 in the wellbore 12, but in other embodiments a different structure may support the workstring 30. In an embodiment, the servicing rig 20 may comprise a derrick with a rig floor through which the workstring 30 extends downward from the servicing rig 20 into the wellbore 12. In some embodiments, such as in an off-shore location, the servicing rig 20 may be supported by piers extending downwards to a seabed. Alternatively, in some embodiments, the servicing rig 20 may be supported by columns sitting on hulls and/or pontoons that are ballasted below the water surface, which may be referred to as a semi-submersible platform or rig. In an off-shore location, a casing 16 may extend from the servicing rig 20 to exclude sea water and contain drilling fluid returns. It is understood that other mechanical mechanisms, not shown, may control the run-in and withdrawal of the workstring 30 in the wellbore 12, for example a draw works coupled to a hoisting apparatus, a slickline unit or a wireline unit including a winching apparatus, another servicing vehicle, a coiled tubing unit, and/or other apparatus.

In an embodiment, the workstring 30 may comprise a conveyance 32 and a perforation tool assembly 34. The conveyance 32 may be any of a string of jointed pipes, a slickline, a coiled tubing, and a wireline. In another embodiment, the workstring 30 may further comprise one or more downhole tools (not shown), for example above the perforation tool assembly 34. The workstring 30 may comprise one or more packers, one or more completion components such as screens and/or production valves, sensing and/or measuring equipment, and other equipment which are not shown in FIG. 1. In some contexts, the workstring 30 may be referred to as a tool string. The workstring 30 may be lowered into the wellbore 12 to position the perforation tool assembly 34 to perforate the casing 16 and penetrate one or more of the production zones 40.

Figure 2:
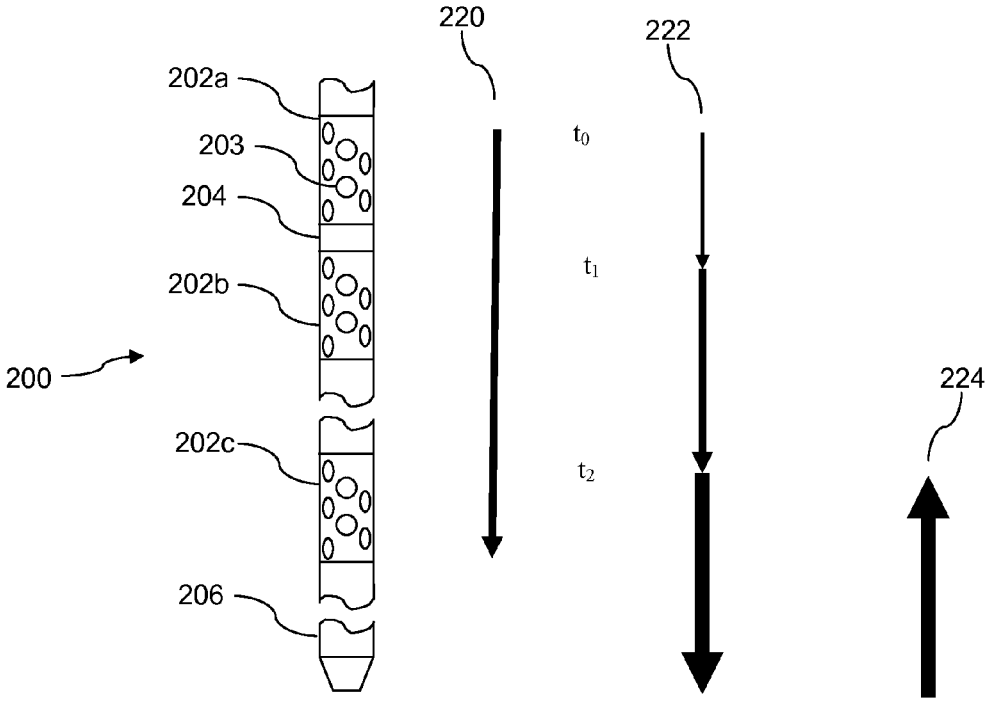
FIG. 2 is an illustration of a perforation tool assembly according to an embodiment of the disclosure.

Turning now to FIG. 2, a perforation tool assembly 200 is described. In an embodiment, the perforation tool assembly 200 comprises a plurality of perforation guns 202 optionally interconnected by one or more spacers 204 and terminated by a foot 206. While the perforation tool assembly 200 is illustrated in FIG. 2 as comprising a first perforation gun 202*a*, a second perforation gun 202*b*, and a third perforation gun 202*c*, it is understood that the perforation tool assembly 200 may comprise any number of perforation guns 202. Each perforation gun 202 comprises one or more explosive charges 203 that desirably perforate the casing 16 and the subterranean formation 14 when the perforation gun 202 is activated and/or fired. The perforation tool assembly 200 may further comprise a firing head (not shown) that initiates a detonation train and/or an energy train to fire the perforation guns 202. The perforation tool assembly 200 may further comprise tandems or other coupling structures (not shown) that are used to promote coupling between perforation guns 202, spacers 204, and/or other components in the perforation tool assembly 200. In an embodiment, the perforation tool assembly 200 may comprise one or more structures for managing the propagation of the shock wave through the perforation tool assembly 200 in response to the perforation guns 202 being fired.

The explosive charges 203 may be shaped charges that focus energy in a preferred direction, for example radially outwards. The explosive charges 203 may be designed to have a relatively unfocused energy projection to produce big, shallow holes in the subterranean formation 14, which may be referred to in some contexts as big hole charges. Alternatively, the explosive charges 203 may be designed to provide highly focused energy projections to produce narrower, deeper penetrations into the subterranean formation 14, which may be referred to in some contexts as deep penetrating charges. In some embodiments, both big hole charges and deep penetrating charges may be mixed in the perforation tool assembly 200 in various ways. For example, one perforation gun 202 may comprise all big hole charges, and another perforation gun 202 may comprise all deep penetrating charges. Alternatively, in an embodiment, the perforation gun 202 may comprise both big hole charges and deep penetrating charges. The perforation gun 202 may comprise a charge carrier that retains the explosive charges 203 within a tool body of the perforation gun 202. The tool body may feature scallops or regions of thinned wall proximate to where the explosive charges 203 will fire through the tool body.

The spacers 204 may be incorporated in the perforation tool assembly 200 to align the perforation guns 202 desirably with different production zones 40. For example, it may be desirable to penetrate the casing 16 to produce from a first zone at between 10200 feet and 10230 feet, to penetrate the casing 16 to produce from a second zone at between 10360 feet and 10380 feet, and to penetrate the casing 16 to produce from a third zone at between 10460 feet and 10480 feet. In this case, a first spacer 130 feet in length may be incorporated between the first perforation gun 202*a* and a second spacer 80 feet in length may be incorporated between the second perforation gun 202*b* and the third perforation gun 202*c*. The spacers 204 may comprise a plurality of connected pipes and/or tubular bodies. In an embodiment, the perforation tool assembly 200 may not have spacers 204.

In an embodiment, the charges 203 in the perforation guns 202 are detonated by the propagation of an energy train 220 directed downwards and parallel to the axis of the perforation tool assembly 200. In this case, the first perforation gun 202*a* is activated by the energy train 220 first, the second perforation gun 202*b* is activated by the energy train 220 second and after the first perforation gun 202*a* is activated, and the third perforation gun 202*c* is activated by the energy train 220 third and after the second perforation gun 202*b* is activated. Assuming that the speed of propagation of the energy train 220 parallel to the axis of the perforation tool assembly 200 is approximately equal to the speed of propagation of a shock wave traveling in a tool body of the perforation tool assembly 200, for example a steel tool body, as each successive perforation gun 202 is fired, a shock wave 222 is created in the perforation tool assembly 200 that propagates downwards and may add to or accumulate with the amplitude of the shock wave already propagating downwards from the previously fired perforation gun 202. It is understood that in some embodiments this accumulation of amplitude or building of the shock wave may be limited or not occur, for example when the detonation speed in the energy train 220 is faster than or slower than the speed of propagation of the shock wave traveling in the tool body of the perforation tool assembly 200. Further, additional shock wave interactions may also be created during the detonation of the perforation guns. For example, a portion of the resulting shock waves can comprise a multi-frequency wave distribution (e.g., distributed in frequency and/or amplitude), which may add or cancel at various locations at various times. Since these additional interactions may not contribute to an overall accumulation of the shock wave, they will not be discussed further herein even though one of ordinary skill in the art will recognize that they are present.

The graphic arrow 222 conceptually represents this building and/or accumulating amplitude of the shock wave as increasingly thick arrows. Note that the explosion of the charges 203 also creates shock waves that propagate up the tool body and up the workstring 30, but these shock waves do not overlap in time and hence do not accumulate in amplitude. When the shock wave 222, which is compressive as it travels downwards, reaches the foot 206 of the perforation tool assembly 200 it reflects back upwards as a tensile shock wave 224.

It is understood that in other embodiments, the perforation guns 202 may be detonated by the propagation of an energy train 220 directed upwards such that the third perforation gun 202*c* is activated by the energy train 220 first, the second perforation gun 202*b* is activated by the energy train 220 second and after the third perforation gun 202*c* is activated, and the first perforation gun 202*a* is activated by the energy train 220 third and after the second perforation gun 202*b* is activated. A shock analysis similar to that for firing from top to bottom can be performed for this firing sequence as well as for other firing sequences, for example where the energy train 220 is first activated between perforation guns 202 and propagates both upwards and downwards at the same time.

The structures that alter the propagation of the shock wave may be incorporated into the perforation tool assembly 200, for example to attenuate the peak magnitude of the shock wave, to change the speed of the shock wave, to change the timing of the shock wave, or to tune the dynamic response of the perforation tool assembly 200 to reduce the shock load on the perforation tool assembly 200. Some of the structures may promote an acoustic impedance mismatch with the remainder of the perforation tool assembly 200 such that some of the shock wave energy is reflected, thereby attenuating the shock wave energy that is propagated in the direction of detonation propagation.

The structures may comprise one or more energy mass absorbers where a mass is suspended within a segment of tubing with energy absorbing elements supporting the mass on one or both ends. When subjected to a large acceleration, for example when the shock wave accelerates the segment of tubing enclosing the mass, the large inertia of the mass resists motion, thus imparting a load on the energy absorber elements supporting the mass. The energy absorbed by the energy absorbing material, for example crushable structures, removes energy from the shock wave. The structures may comprise a deformable energy absorber having non-linear elasticity. This deformable energy absorber may flex very little in response to shock loads up to a threshold level and then, for shock loads above this threshold, yield readily.

The structures may comprise one or more energy mass absorbers where a mass is suspended within a segment of tubing with springs (e.g., elastic elements) supporting the mass on either end. The mass-spring system may comprise a natural resonance frequency based on the properties of the mass and the springs. The shock wave may cause the mass to oscillate within the segment of tubing, thereby damping the perforation tool assembly 200 motion at or near the natural resonance frequency. The properties of the mass and/or the springs could be tuned to match the characteristics of the perforation tool assembly 200 and the expected shock and/or loads within the system. One or more of the energy absorbing elements may be used with the springs to further dampen and/or dissipate the energy within the system.

Figure 3:
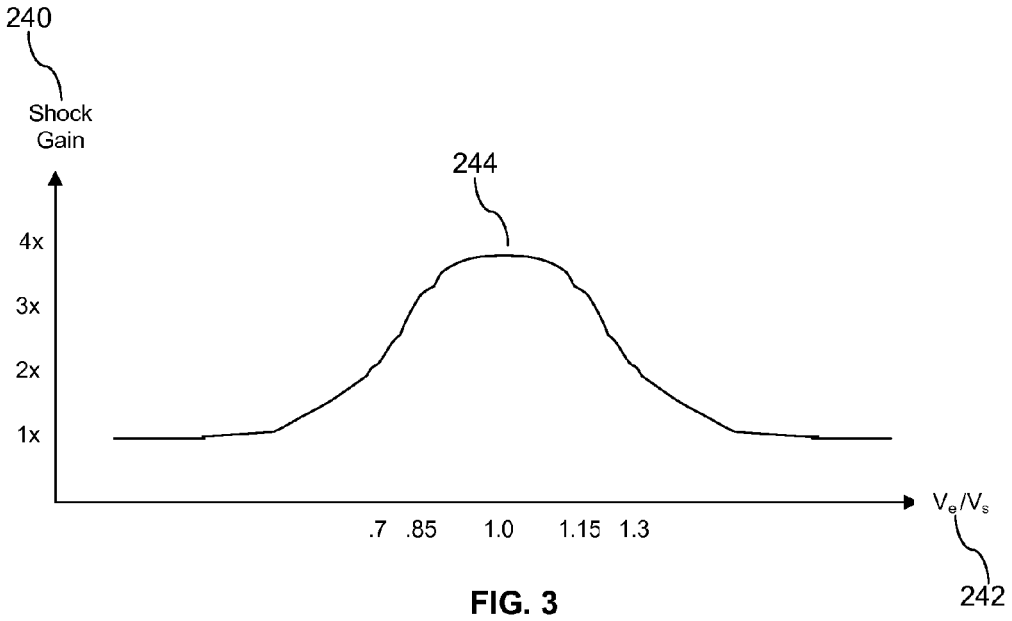
FIG. 3 is an illustration of an exemplary shock load function according to an embodiment of the disclosure.

Turning now to FIG. 3, a shock accumulation 240 is represented as a function of a ratio $V_e/V_s$ 242 of a speed of the energy train propagation in the direction parallel to the axis of the perforation tool assembly 200, $V_e$, to a speed of the shock wave propagation in the tool body in the direction parallel to the axis of the perforation tool assembly 200, $V_s$. Note that the example discussed with reference to FIG. 3 is directed to a tool gun string 200 that does not employ the structures and methods of energy propagation management described herein. When $V_e$ is substantially less than $V_s$ or substantially greater than $V_s$, the shock waves associated with the detonation of the charges in the perforation guns 202 do not align sufficiently to significantly boost the amplitude of the shock wave. When $V_e$ and $V_s$ approach an equal value, however, the shock waves associated with the detonation of the charges in the perforation guns 202 begin to accumulate in magnitude, an effect which may be referred to as shock accumulation 240 and/or shock gain. The shock accumulation 240 may be mapped to a shock load which may be quantified in units of force.

It is understood that the function depicted in FIG. 3 is exemplary and that in different specific implementations of the perforation tool assembly 200, a different relationship between the ratio $V_e/V_s$ 242 and the shock accumulation 240 may be applicable. The maximum amplitude gain 244 may depend upon the total charge load, which may depend at least in part on the number and properties of the charges that are exploded, and/or the distribution of the charge load within the perforation guns. Additionally, the maximum amplitude gain 244 may further depend on the elasticity of the tool body and/or the extent to which the energy in the shock wave is dissipated and/or decays in the tool body. A shock load imparted by exploding charges may initially have a short duration, high amplitude but may become spread out in time as a lower amplitude, longer duration wave as the shock wave propagates in the tool body. The present disclosure teaches managing shock load propagation by absorbing shock load energy and/or frequency shifting some of the shock load energy, which may reduce the shock accumulation 240.

Figure 4A:
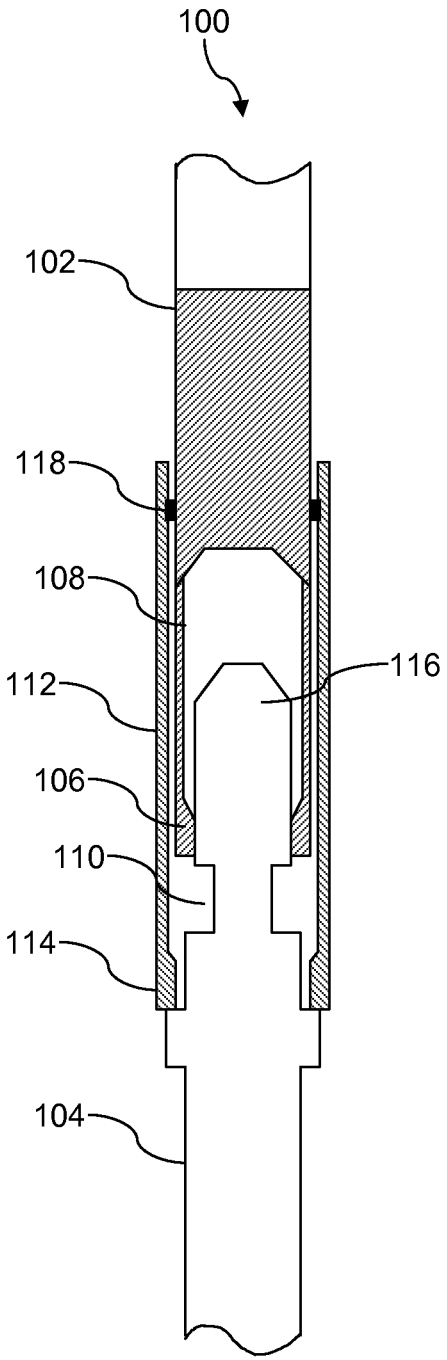
FIG. 4A is an illustration of a tool string connector and a perforation gun in a first state according to an embodiment of the disclosure.
Figure 4B:
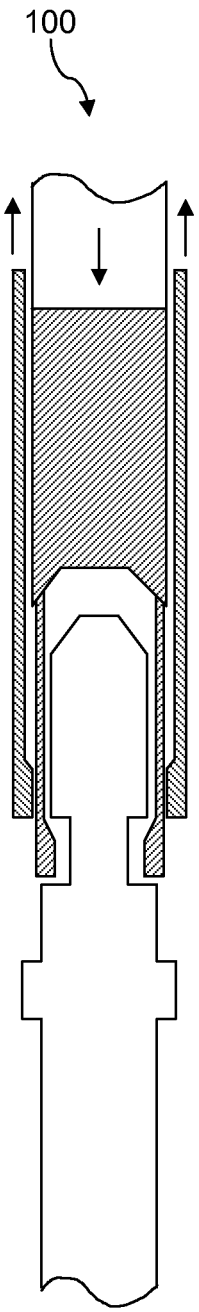
FIG. 4B is an illustration of the tool string connector and a perforation gun in a second state according to an embodiment of the disclosure.

Turning now to FIG. 4A and FIG. 4B, an assembly 100 is described. In an embodiment, the assembly 100 comprises a tool string connector 102 and a perforation gun 104. The assembly 100 may be made-up or coupled together on a floor of the servicing rig 20 before running the workstring 30 into the wellbore 12. Alternatively, the assembly 100 may be coupled together below the floor of the servicing rig 20, for example within a Christmas tree over the wellbore 12. The assembly 100 may form a portion of the perforation tool assembly 200 described above. In some embodiments, the assembly 100 may comprising an auto-latch coupling. An auto-latching coupling may reduce the time of making connections among some assemblies in the perforation tool assembly 34. For further details about auto-latching couplings, see U.S. Pat. No. 5,778,979, entitled "Latch and Release Perforating Gun Connector and Method," by John D. Burleson, et al.; U.S. Pat. No. 5,992,523, entitled "Latch and Release Perforating Gun Connector and Method," by John D. Burleson, et al.; U.S. Pat. No. 5,823,266, entitled "Latch and Release Tool Connector and Method," by John D. Burleson, et al.; and U.S. Pat. No. 5,957,209, entitled "Latch and Release Tool Connector and Method," by John D. Burleson, et al.; each of which is hereby incorporated by reference in its entirety.

In an embodiment, the perforation gun 104 comprises a stinger 116 and a circumferential groove 110. In some contexts, the stinger 116 and 110 may be referred to as a latch mate of the perforation gun 104. It is understood that the perforation gun 104 further comprises a tool body and a plurality of explosive charges 203 that are retained in a charge carrier within the tool body. The charge carrier may be fabricated from a thin metal tube that has holes cut out to receive and retain the explosive charges 203. The charge carrier may be secured within the tool body of the perforation gun 104 by materials that serve as shock absorbers to protect the charge carrier and charges 203 from axial and/or radial accelerations that may be experienced during run-in of the workstring 30. The distinction between the shock absorbers that protect the charge carrier and charges 203 during run-in and the mechanical energy absorber components discussed further below that reduce the shock load associated with the firing of the perforation guns 202 and/or 104 will be readily appreciated by one skilled in the art of perforation guns and downhole operations. The accelerations associated with run-in are orders of magnitude less intense than the accelerations associated with the shock load resulting from firing the perforation guns 202, 104. Additionally, in an embodiment, the shock absorbers may protect the charge carriers, which may not be in the primary load path of the perforation tool assembly 34 and consequently may not significantly affect the shock wave propagation in the primary load path of the perforation tool assembly 34. Still further, the shock absorbers within the perforation guns are effectively destroyed by the detonation of the explosive charges, thereby removing any shock absorbing capabilities once the explosive charges are detonated.

In an embodiment, the tool string connector 102 comprises a collet 106 and associated collet fingers 108, a sleeve 112, a collet prop 114, and a one or more shear pins 118. In some contexts, the collet 106, collet fingers 108, sleeve 112, collet prop 114 may be referred to as a latch component. When the tool string connector 102 is lowered onto the perforation gun 104, the collet 106 receives the stinger 116, the collet fingers 108 flex to allow the collet 106 to slide over the outside of the stinger 116, and the collet 106 engages with the groove 110. The assembly 100 is illustrated in FIG. 4A during the course of this engagement, just before the collet 106 engages with the groove 110. Once the collet 106 engages with the groove 110, the sleeve 112 may be raised so that the collet prop 114 props the collet 106, as illustrated in FIG. 4B. The sleeve 112 may be shifted or slid upwards by springs that form part of the tool string connector 102 or by a tool that grips the outside of the sleeve 112 and lifts it. When the tool string connector 102 and the perforation gun 104 are in the state illustrated in FIG. 4B, the latch mate of the perforation gun 104 and the latch component of the tool string connector 102 may be said to be engaged or to engage each other. The perforation gun 104 is coupled to the tool string connector 102 in the state of the assembly 100 illustrated in FIG. 4B.

It is understood that in other embodiments the tool string connector 102 may comprise additional components. In an embodiment, the sleeve 112 may be retained in position by a latching mechanism or by engaging with another mechanism of the tool string connector 102. This latching mechanism may be manipulable by a tool at the surface to allow the sleeve 112 to be retracted and to un-make the coupling between the tool string connector 102 and the perforation gun 104. In an embodiment, the latching mechanism may be configured to remain latched in the presence of high shock loads and to not rattle into an unlatched state during a perforation event. It is understood that the tool string connector 102 may be either up-hole or down-hole of the perforation gun 104. The tool string connector 102 may have a threaded end (not shown) that may couple threadingly to another perforation gun 202, 104, for example at an end opposite to the latch component of the tool string connector 102.

Figure 5:
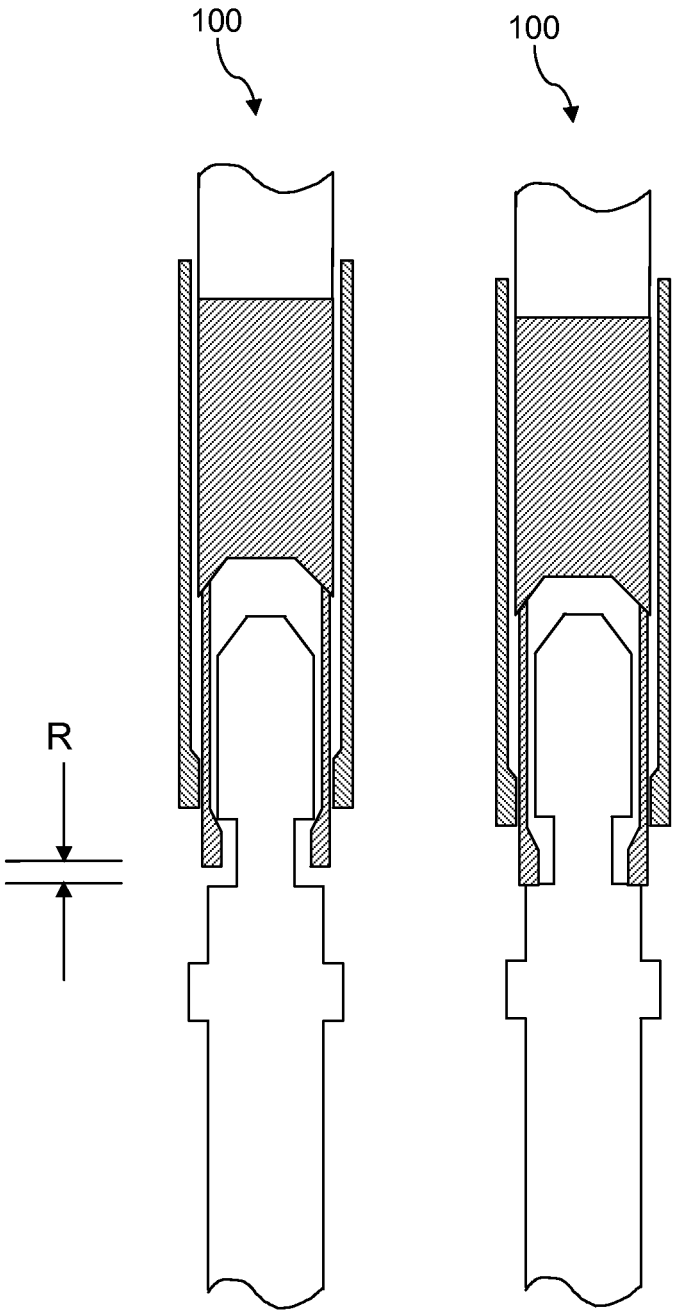
FIG. 5 is an illustration of the tool string connector and a perforation gun in the second state exhibiting a range of motion of the tool string connector relative to the perforation gun according to an embodiment of the disclosure.

Turning now to FIG. 5, a range of motion R of the tool string connector 102 relative to the perforation gun 104 is illustrated. The range of motion R may promote decoupling the shock load between perforation guns 202, 104. In an embodiment, the range of motion R may be limited to an axial motion of less than about 5 inches. In another embodiment, the range of motion R may be limited to an axial motion of less than about 2 inches. In another embodiment, the range of motion R may be limited to an axial motion of less than about 1 inch.

Figure 6A:
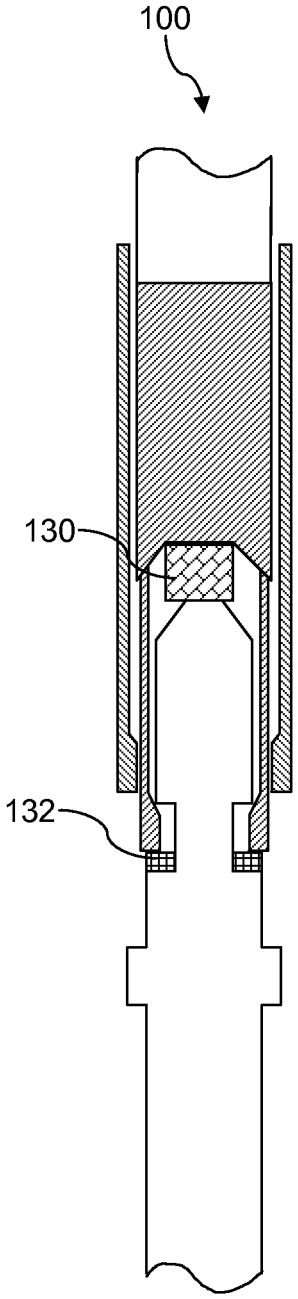
FIG. 6A is an illustration of the tool string connector and a perforation gun retaining a first mechanical energy absorbing structure in the first state according to an embodiment of the disclosure.
Figure 6B:
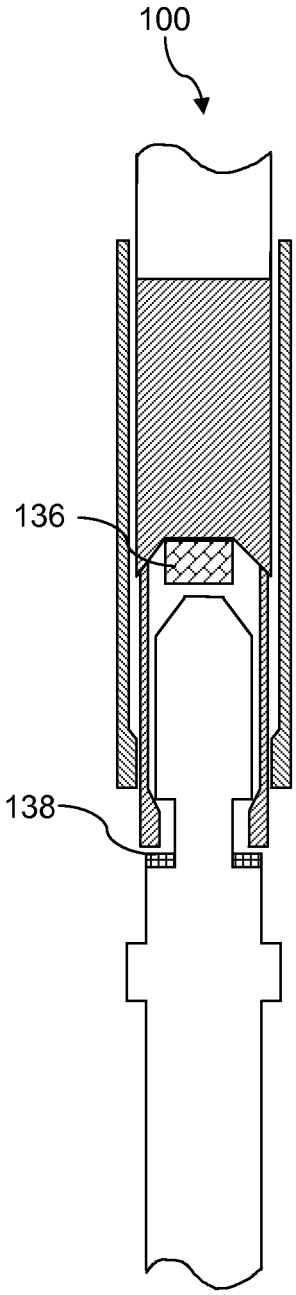
FIG. 6B is an illustration of the tool string connector and a perforation gun retaining a second mechanical energy absorbing structure in the first state according to an embodiment of the disclosure.

Turning now to FIG. 6A and FIG. 6B, the assembly 100 is illustrated with mechanical energy absorbing structures. In an embodiment, the assembly 100 may comprise a first energy absorber 130 between the stinger 116 and an interior of the tool string connector 102. In an embodiment, the assembly 100 may comprise a second energy absorber 132 between the collet 106 and a shoulder of the circumferential groove 110 of the perforation gun 104. The energy absorbing structures may be dimensioned to prevent relative motion between the tool string connector 102 and the perforation gun 104 during run-in, as seen in FIG. 6A. Alternatively, the energy absorbing structures may be dimensioned to allow some relative motion between the tool string connector 102 and the perforation gun 104 during run-in, as seen as first energy absorber 136 and second energy absorber 138 in FIG. 6B. The energy absorbing structures 130, 132, 136, 138, generally, may be designed to withstand compression and tensile forces up to a threshold, where the threshold is much greater than the customary run-in forces and/or accelerations. The energy absorbing structures 130, 132, 136, 138 may be designed to deform, to allow motion of the perforation gun 104 relative to the tool string connector 102 by non-restorative deforming, for example compressing, while under a relatively high load such as that presented during a perforation event. The energy absorbed is related to the force applied to the absorbing structure multiplied by the distance by which the structure 130, 132, 136, 138 is non-restoratively compressed: force times distance. The energy absorbing structures 130, 132, 136, 138 may absorb energy in the shock load and/or shock wave propagating in the perforation tool assembly 200 and associated with firing one or more perforation guns and/or associated with an induced dynamic underbalance condition.

Figure 7A:
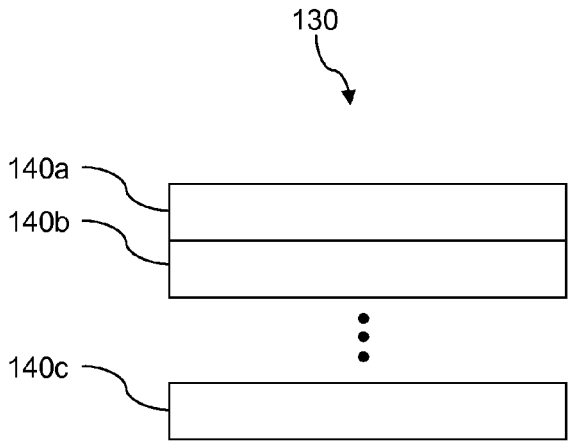
FIG. 7A is an illustration of a mechanical energy absorbing structure viewed from the edge according to an embodiment of the disclosure.
Figure 7B:
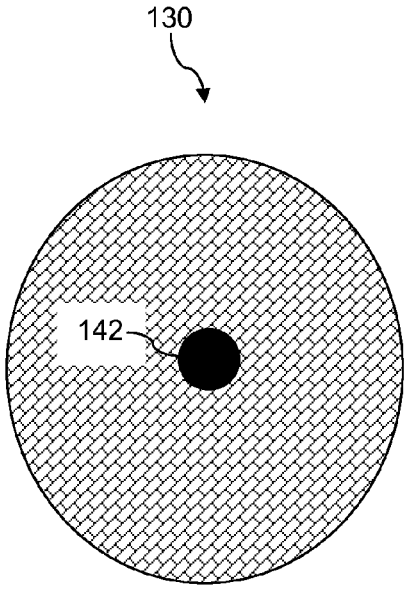
FIG. 7B is an illustration of the mechanical energy absorbing structure viewed from above according to an embodiment of the disclosure.

Turning now to FIG. 7A and FIG. 7B, the first energy absorber 130, 136 is discussed further. In an embodiment, the first energy absorber 130, 136 may comprise a plurality of disks 140, for example a first disk 140*a*, a second disk 140*b*, and a third disk 140*c*. It is understood that the first energy absorber 130, 136 may alternatively comprise a single disk, two disks, or more than three disks. The disks 140 may have a hole 142 that allows primacord or detonation cord to pass through the first energy absorber 130, 136. The disks 140 may comprise honeycomb material that acts as an energy absorber when crushed. The disks 140 may comprise ductile metal that acts as an energy absorber when compressed beyond the elastic limit and/or beyond the yield point of the ductile metal.

The disks 140 and/or the first energy absorber 130, 136 may be designed to sustain multiple shock loads, for example shock loads that may be separated in time. For example, in an embodiment, the first energy absorber 130, 136 may be designed to sustain shock load peaks that are separated by at least one second, by at least about two seconds, at least about three seconds, at least about ten seconds, or at least about thirty seconds. In the case of multiple shock load peaks or multiple shock hits, the first energy absorber 130, 136 may deform a fraction of a deformation capacity of the absorber 130, 136 during each hit. In an embodiment, the first energy absorber 130, 136 may be designed to sustain a maximum number of shock load hits, for example three shock load hits, five shock load hits, ten shock load hits, or some other number of shock load hits. The disks 140 may comprise frangible material that acts as an energy absorber when crushed. In an embodiment, one or more of the disks 140 may comprise a nonlinear spring, for example a wave-type spring and/or a Belleville-type spring. The disks 140 may be referred to in some contexts as washer-shaped.

Figure 8:
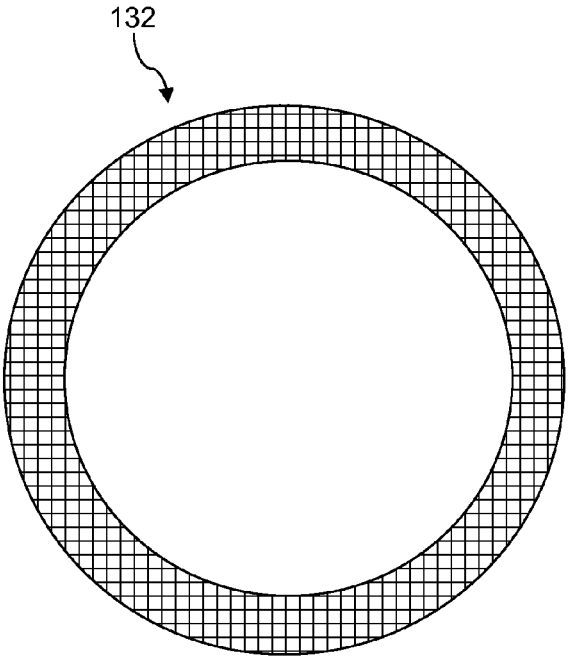
FIG. 8 is an illustration of a mechanical energy absorbing structure viewed from above according to an embodiment of the disclosure.

Turning now to FIG. 8, the second energy absorber 132, 138 is discussed further. In an embodiment, the second energy absorber 132, 138 may be embodied in a form substantially similar to that of the first energy absorber 130, 136 described above and may be designed to sustain a plurality of shock wave hits. The second energy absorber 132, 138 may comprise a plurality of disks. The disk or disks may comprise honeycomb material, crushable tubes, ductile metal, and/or frangible material. The second energy absorber 132, 138 has a large opening that corresponds to the outside diameter of the circumferential groove 110. In an embodiment, the second energy absorber 132, 138 may have the form of a split ring that may be opened to put the second energy absorber 132, 138 onto the circumferential groove 110. Alternatively, the second energy absorber 132, 138 may be provided in two halves that are assembled into the circumferential groove 110 at the wellbore 12. In an embodiment, the second energy absorber 132, 138 may comprise one or more nonlinear springs, for example a wave-type spring and/or a Belleville-type spring. The second energy absorber 132, 138 may be referred to in some contexts as washer-shaped.

Figure 9A:
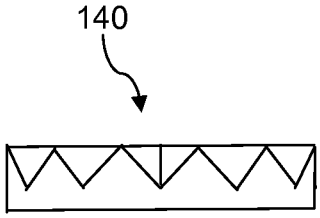
FIG. 9A is an illustration of a mechanical energy absorbing structure viewed from the edge according to an embodiment of the disclosure.
Figure 9B:
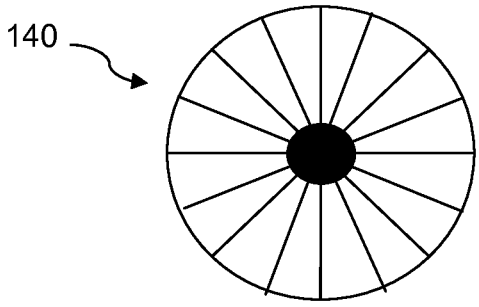
FIG. 9B is an illustration of a mechanical energy absorbing structure viewed from above.
Figure 10:
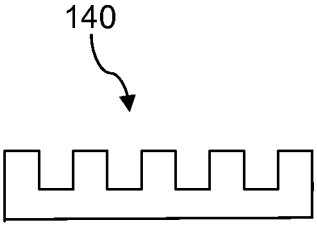
FIG. 10 is an illustration of a mechanical energy absorbing structure viewed from the edge according to an embodiment of the disclosure.
Figure 11:
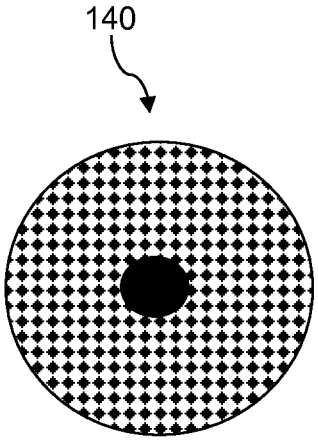
FIG. 11 is an illustration of a mechanical energy absorbing structure viewed from above according to an embodiment of the disclosure.

Turning now to FIG. 9A, FIG. 9B, FIG. 10, and FIG. 11, examples of a disk 140 are described. In an embodiment, one or more of the disks 140 may be formed of a ductile metal that has grooves or flutes cut or cast into the disk 140, as illustrated in FIG. 9A and FIG. 9B. When a compression or crushing force is applied to the faces of the disk 140, the force is borne initially by the peaks of the grooves or flutes. As the disk 140 flattens, the resisting force of the disk 140 increases as the peaks of the grooves or flutes are flattened out and the force is distributed across a greater area. The crushing of the disk 140 may be said to be non-restorative. Energy in the shock load propagation is consumed during the process of flattening the peaks of the grooves or flutes, and therefore the shock load that propagates from the perforation gun 104 to the tool string connector 102 or from the tool string connector to the perforation gun 104 is reduced. The same analysis of the crushing of the ductile disk 140 can be adapted to apply to a disk 140 that has a crenellated surface with a square or rectangular pattern as illustrated in FIG. 10 or that has a knurled surface as illustrated in FIG. 11. Any ductile metal may be used to form the disk 140, for example brass. The second energy absorber 132 may be formed of a ductile metal having similar grooves and/or irregularities in one of its surfaces.

In an embodiment, a set of disks 140 may be available at the location of the wellbore 12. The set of disks 140 promotes composing the first energy absorber 130, 136 out of a set of different designed disks 140, for example disks that have different amounts of compliance or different amounts of resistance to compression forces, according to a design or recipe for building the assembly 100. Likewise, a set of different second energy absorbers 132, 138 having different energy absorption characteristics may be available for building the assembly 100. In some contexts, the set of disks 140 having different energy absorption characteristics may be referred to as interchangeable energy absorption components or as interchangeable components.

Figure 12:
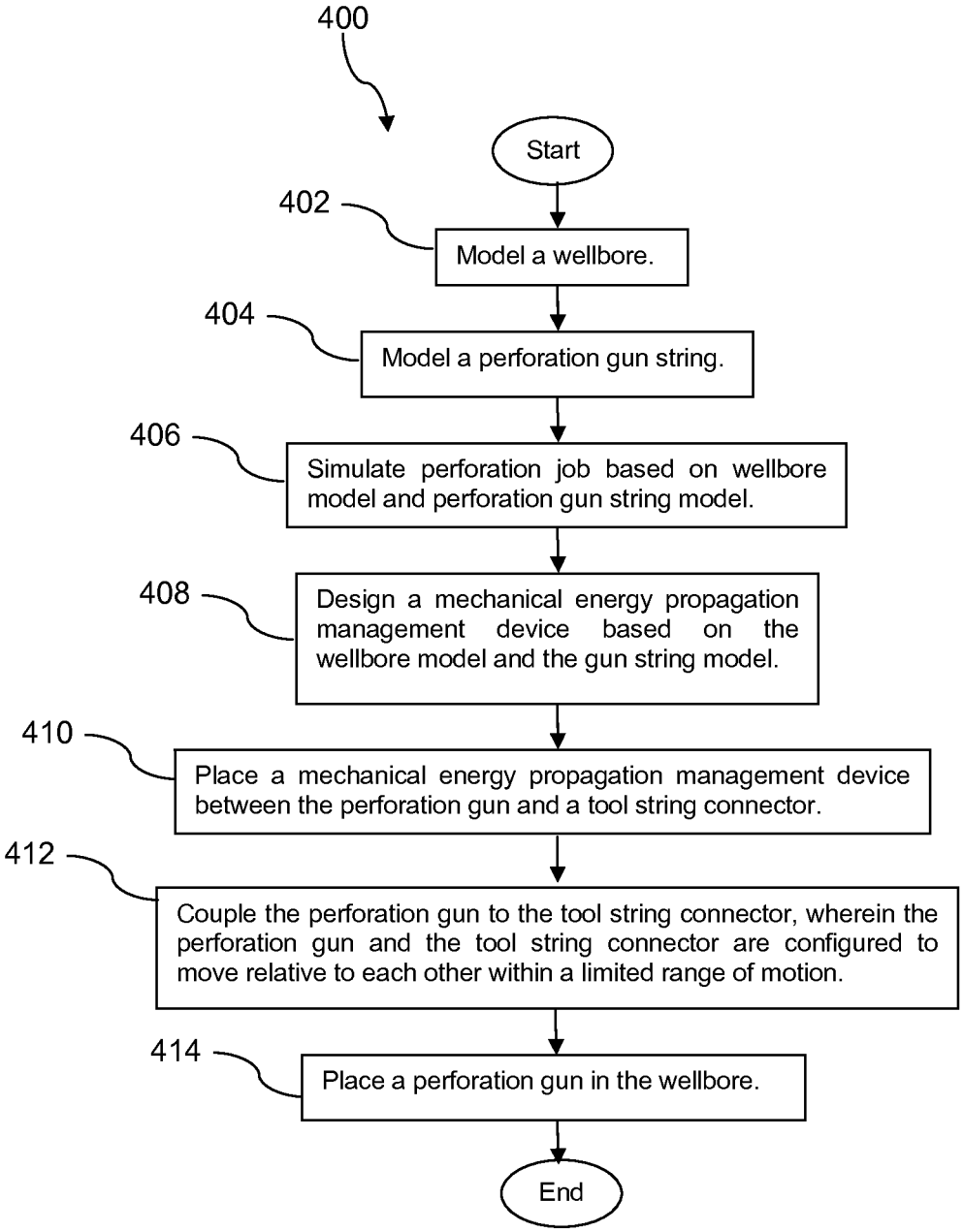
FIG. 12 is a flow chart of a method according to an embodiment of the disclosure.

Turning now to FIG. 12, a method 400 is described. At block 402 the wellbore 12 is modeled. At block 404 the perforation gun string 202 is modeled. At block 406, a perforation job is simulated based on the wellbore model and the perforation gun string model. The results of the simulation are analyzed to determine the effectiveness of the simulated perforation job, comparing the simulated results to the preferred results. At block 408, a mechanical energy propagation management device is designed based on the simulation and/or based on the wellbore model and the gun string model. For example, one or more energy absorbers 130, 132, 136, 138 are designed. For example, a mass energy absorber system, as described further below, is designed. The processing of blocks 402, 404, and 408 may be repeated or iterated a plurality of times to improve or optimize the design of the mechanical energy propagation management device or other parameters of the perforation gun string 202. The design of the energy absorbers 130, 132, 136, 138 may be based on absorbing the shock wave peaks of multiple independent perforation gun 202, 104 firings, for example multiple hits. In an embodiment, the processing of blocks 402, 404, 406, and 408 may be omitted.

At block 410, a mechanical energy propagation management device is placed between the perforation gun and a tool string connector, for example, the mechanical energy propagation management device designed in block 408. For example, one or more energy absorbers 130, 132, 136, 138 designed in block 408 above are placed between the perforation gun and a tool string connector. At block 412, the perforation gun 104 is coupled to the tool string connector 102, wherein the perforation gun and the tool string connector are configured to move relative to each other within a limited range of motion when the mechanical energy propagation management device is not present. The term mechanical energy propagation management device may comprise one or more of energy absorbers 130, 132, 136, 138 and/or a mass energy absorber system, as described further below. At block 414, a perforation gun is placed in the wellbore 12. For example, the perforation gun designed in block 408 is placed in the wellbore 12.

Figure 13:
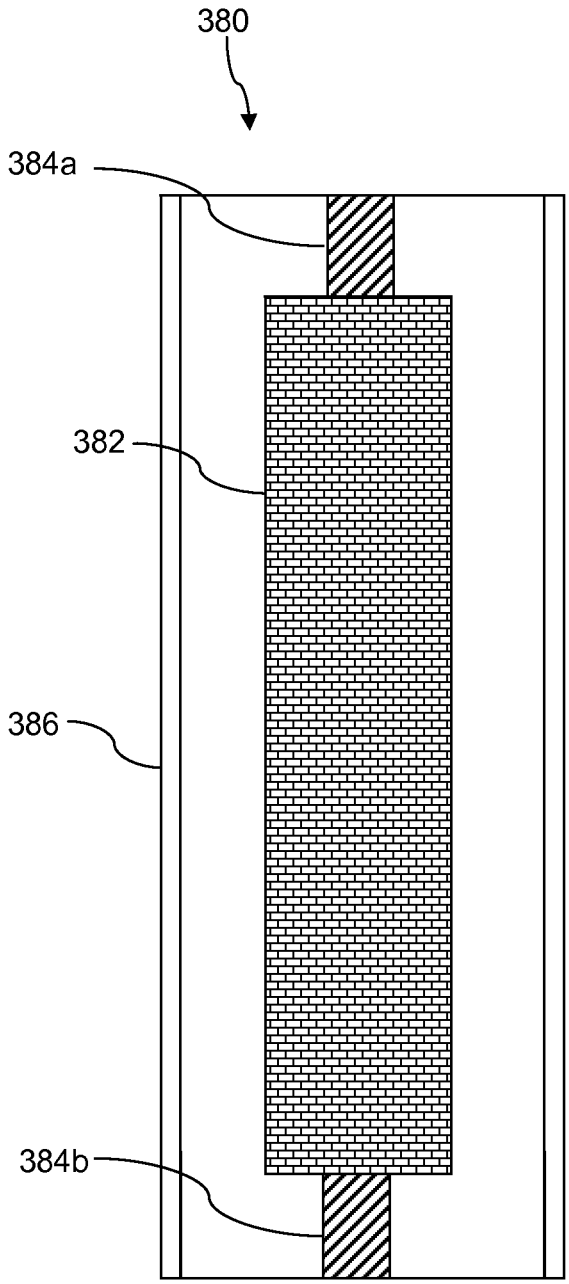
FIG. 13 is an illustration of mass energy absorber according to an embodiment of the disclosure.

Turning now to FIG. 13, a mass energy absorber 380 is described. In some contexts, the mass energy absorber 380 may be referred to as a tuned mass energy absorber. The mass energy absorber 380 may be designed through modeling and simulation as described above. The mass energy absorber 380 is suitable for incorporation into the perforation tool assembly 200 to alter the propagation of the shock wave through the perforation tool assembly 200. For example, the mass energy absorber 380 may be provided between other components of the perforation tool assembly 200, for example between perforation guns 202 and/or spacers 204. The mass energy absorber 380 may be coupled to a first component up-hole and to a second component down-hole from the mass energy absorber 380. A plurality of mass energy absorbers 380 may be coupled to each other. It is understood that a plurality of mass energy absorbers 380 may be placed at one or more positions within the perforation tool assembly 200.

In an embodiment, the mass energy absorber 380 comprises a mass 382 and at least one absorber disposed between at least one end and the tool body 386. For example, the mass energy absorber 380 may comprise a mass 382 supported in a first end by a first absorber 384*a* and supported on a second end by a second absorber 384*b*. The mass 382 may be centralized within the tool body 386 by soft polymeric stand-off buttons or rings or other structures that exhibit low axial coupling between the mass 382 and the tool body 386. The mass 382 may comprise tungsten, depleted uranium, or other dense materials. The absorbers 384*a*, 384*b* are coupled to and support the mass 382 within a tool body 386 without deformation during normal displacements of the mass energy absorber 380 and/or the perforation tool assembly 200, for example during run-in. When a shock wave propagates to the mass energy absorber 380 via coupling of the tool body 386 to the perforation tool assembly 200, the inertia of the mass 382 resists displacement, the absorbers 384 deform, energy is removed from the shock wave, and the shock load that propagates on beyond the mass energy absorber 380 is attenuated.

The absorbers 384 may comprise crushable structures such as a non-linear stiffness device that is designed to be relatively stiff until a critical load or stress level is reached, at which point the absorber loses its stiffness and absorbs energy. The absorbers 384 may comprise materials that deform non-restoratively. The absorbers 384 may comprise devices similar to those described above with reference to assembly 100: honeycomb structures, crushable tubes, deformable washers of ductile metals, deformable washers of ductile metals having a grooved, fluted, crenelated, or knurled surface. While the absorbers 384 are illustrated in FIG. 9 as substantially similar is dimension, the first absorber 384*a* may have different dimensions, different compliance, and/or different energy absorption characteristics. For example, if the expected shock wave is simulated to propagate from above and down through the mass energy absorber, the first absorber 384*a* may be called upon to absorb more energy than the second absorber 384*b*. Additionally, the sense of the stress placed upon the absorbers 384 may be different. For example, the first absorber 384*a* may experience a greater compression stress than a tensile stress, while the second absorber 384*b* may experience a greater tensile stress than compression stress. In an embodiment, hence, the first absorber 384*a* may be designed differently than the second absorber 384*a*.

The absorbers 384 and/or the mass 382 may be designed for altering shock waves associated with a plurality of separate, distinct shock events. For example, the absorbers 384 may partially crush in response to and alter the propagation of a first shock wave associated with firing a first perforation gun; the absorbers 384 may further crush in response to and alter the propagation of a second shock wave associated with firing a second perforation gun after the firing of the first perforation gun; and the absorbers 384 may yet further crush in response to and alter the propagation of a third shock wave associated with firing a third perforation gun after the firing of the second perforation gun. In some contexts, such separate, distinct shock events may be referred to as time separated shock events or as time separated perforation gun firings. In an embodiment, the second shock wave may be associated with firing a second perforation gun at least about 1 second later, at least about 10 seconds later, or at least about 30 seconds later than the firing of the first perforation gun. In an embodiment, the third shock wave may be associated with firing a third perforation gun at least about 1 second later, at least about 10 seconds later, or at least about 30 seconds later than the firing of the second perforation gun.

In an embodiment, the mass energy absorber 380 may further comprise linear springs or non-linear springs, which may replace or be used in combination with one or more of the energy absorbers between the mass 382 and the tool body 386. In an embodiment, mass energy absorber 380 comprises a mass 382 suspended within the tool body 386 by one or more springs (e.g., elastic elements, restorative springs, absorbing springs, etc.) supporting the mass 382 on either end. The configuration of the mass energy absorber 380 may be the same as illustrated in FIG. 13, with the elements 384*a*, 384*b* comprising springs rather than absorbers. In some embodiments, the springs may act as energy absorbers by either having some degree of resistance and/or incorporating resistive or deformative elements.

The mass energy absorber 380 may comprise a natural resonance frequency based on the properties of the mass and the springs. The shock wave may cause the mass to oscillate within the segment of tubing, thereby damping the perforation tool assembly 200 motion at or near the natural resonance frequency. The properties of the mass and/or the springs could be tuned to match the characteristics of the perforation tool assembly 200 and the expected shock and/or loads within the system. One or more of the energy absorbing elements may be used with the springs to further dampen and/or dissipate the energy within the system. Further, a plurality of mass energy absorbers 380 may be disposed in the tool string, each with the same or different properties, for example, to dampen the shock load at various natural resonance frequencies along the string. The mass energy absorbers may be disposed in a single tool body 386 or a plurality of tool bodies, and the tool bodies may be coupled to each other and/or distributed throughout the perforation gun string.

When a shock wave propagates to the mass energy absorber 380 via coupling of the tool body 386 to the perforation tool assembly 200, the inertia of the mass 382 resists displacement, but will begin to oscillate at the natural frequency based on the properties of the one or more springs and the mass. The resulting oscillation may serve to convert the shock wave into different frequencies and/or change the amplitude of the shock wave (e.g., spread out the shock wave to thereby reduce the peak amplitude) as the mass energy absorber 380 begins to oscillate and thereafter transfers the energy back to the tool body 386. As noted above, due to the natural losses in the springs and if one or more absorbers are present, the energy may be dissipated prior to being transferred back to the tool body 386.

It is understood that the mass energy absorber 380 may be implemented in other configurations than those described with reference to FIG. 13. For further details about energy absorbers and shock load mitigation, see U.S. patent application Ser. No. 13/377,148, filed Dec. 8, 2011, entitled "Shock Load Mitigation in a Downhole Perforation Tool Assembly," by Timothy S. Glenn, et al., which is hereby incorporated by reference in its entirety.

Figure 14:
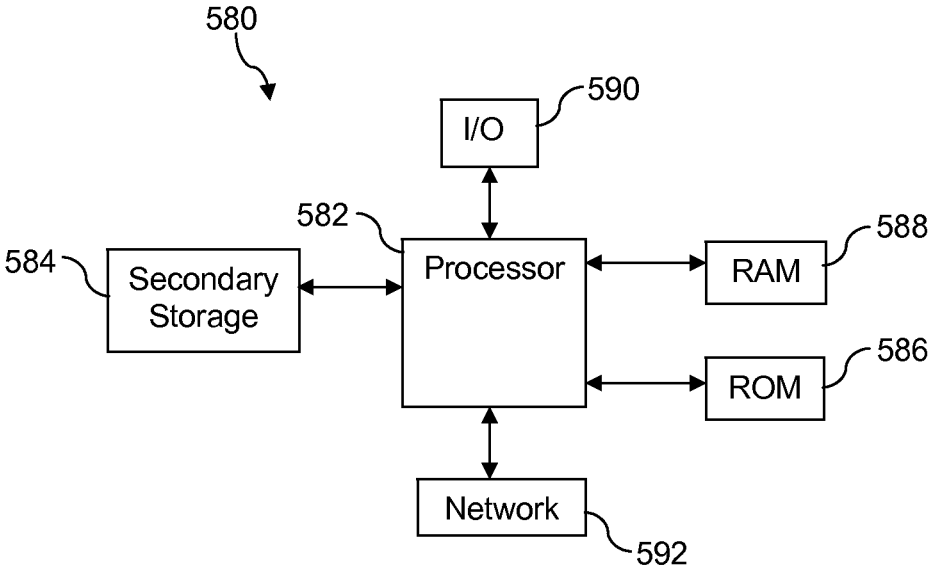
FIG. 14 is an illustration of a computer system according to an embodiment of the disclosure.

FIG. 14 illustrates a computer system 580 suitable for implementing one or more embodiments disclosed herein. For example, the analysis performed in blocks 402, 404, and/or 406 of method 400 described above with reference to FIG. 12 may be promoted by executing a modeling application on the computer system 580. Further, the designing performed in block 206 may be performed at least in part using a design application executing on the computer system 580. The computer system 580 includes a processor 582 (which may be referred to as a central processor unit or CPU) that is in communication with memory devices including secondary storage 584, read only memory (ROM) 586, random access memory (RAM) 588, input/output (I/O) devices 590, and network connectivity devices 592. The processor 582 may be implemented as one or more CPU chips.

It is understood that by programming and/or loading executable instructions onto the computer system 580, at least one of the CPU 582, the RAM 588, and the ROM 586 are changed, transforming the computer system 580 in part into a particular machine or apparatus having the novel functionality taught by the present disclosure. It is fundamental to the electrical engineering and software engineering arts that functionality that can be implemented by loading executable software into a computer can be converted to a hardware implementation by well known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

The secondary storage 584 is typically comprised of one or more disk drives or tape drives and is used for non-volatile storage of data and as an over-flow data storage device if RAM 588 is not large enough to hold all working data. Secondary storage 584 may be used to store programs which are loaded into RAM 588 when such programs are selected for execution. The ROM 586 is used to store instructions and perhaps data which are read during program execution. ROM 586 is a non-volatile memory device which typically has a small memory capacity relative to the larger memory capacity of secondary storage 584. The RAM 588 is used to store volatile data and perhaps to store instructions. Access to both ROM 586 and RAM 588 is typically faster than to secondary storage 584. The secondary storage 584, the RAM 588, and/or the ROM 586 may be referred to in some contexts as computer readable storage media and/or non-transitory computer readable media.

I/O devices 590 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 592 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as code division multiple access (CDMA), global system for mobile communications (GSM), long-term evolution (LTE), worldwide interoperability for microwave access (WiMAX), and/or other air interface protocol radio transceiver cards, and other well-known network devices. These network connectivity devices 592 may enable the processor 582 to communicate with the Internet or one or more intranets. With such a network connection, it is contemplated that the processor 582 might receive information from the network, or might output information to the network in the course of performing the above-described method steps. Such information, which is often represented as a sequence of instructions to be executed using processor 582, may be received from and outputted to the network, for example, in the form of a computer data signal embodied in a carrier wave.

Such information, which may include data or instructions to be executed using processor 582 for example, may be received from and outputted to the network, for example, in the form of a computer data baseband signal or signal embodied in a carrier wave. The baseband signal or signal embodied in the carrier wave generated by the network connectivity devices 592 may propagate in or on the surface of electrical conductors, in coaxial cables, in waveguides, in an optical conduit, for example an optical fiber, or in the air or free space. The information contained in the baseband signal or signal embedded in the carrier wave may be ordered according to different sequences, as may be desirable for either processing or generating the information or transmitting or receiving the information. The baseband signal or signal embedded in the carrier wave, or other types of signals currently used or hereafter developed, may be generated according to several methods well known to one skilled in the art. The baseband signal and/or signal embedded in the carrier wave may be referred to in some contexts as a transitory signal.

The processor 582 executes instructions, codes, computer programs, scripts which it accesses from hard disk, floppy disk, optical disk (these various disk based systems may all be considered secondary storage 584), ROM 586, RAM 588, or the network connectivity devices 592. While only one processor 582 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 584, for example, hard drives, floppy disks, optical disks, and/or other device, the ROM 586, and/or the RAM 588 may be referred to in some contexts as non-transitory instructions and/or non-transitory information.

In an embodiment, the computer system 580 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 580 to provide the functionality of a number of servers that is not directly bound to the number of computers in the computer system 580. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 580, at least portions of the contents of the computer program product to the secondary storage 584, to the ROM 586, to the RAM 588, and/or to other non-volatile memory and volatile memory of the computer system 580. The processor 582 may process the executable instructions and/or data structures in part by directly accessing the computer program product, for example by reading from a CD-ROM disk inserted into a disk drive peripheral of the computer system 580. Alternatively, the processor 582 may process the executable instructions and/or data structures by remotely accessing the computer program product, for example by downloading the executable instructions and/or data structures from a remote server through the network connectivity devices 592. The computer program product may comprise instructions that promote the loading and/or copying of data, data structures, files, and/or executable instructions to the secondary storage 584, to the ROM 586, to the RAM 588, and/or to other non-volatile memory and volatile memory of the computer system 580.

In some contexts, a baseband signal and/or a signal embodied in a carrier wave may be referred to as a transitory signal. In some contexts, the secondary storage 584, the ROM 586, and the RAM 588 may be referred to as a non-transitory computer readable medium or a computer readable storage media. A dynamic RAM embodiment of the RAM 588, likewise, may be referred to as a non-transitory computer readable medium in that while the dynamic RAM receives electrical power and is operated in accordance with its design, for example during a period of time during which the computer 580 is turned on and operational, the dynamic RAM stores information that is written to it. Similarly, the processor 582 may comprise an internal RAM, an internal ROM, a cache memory, and/or other internal non-transitory storage blocks, sections, or components that may be referred to in some contexts as non-transitory computer readable media or computer readable storage media.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A perforation tool assembly, comprising a tool string connector comprising a collet and a sleeve;

a perforation gun coupled to the tool string connector by the collet and the sleeve forming a coupling; and an energy absorber configured to absorb mechanical energy released by firing one or more perforation guns, wherein the coupling between the perforation gun and the tool string connector is configured to provide a limited range of motion of the tool string connector relative to the perforation gun, and wherein the tool string connector and the perforation gun retain the energy absorber configured to absorb mechanical energy.

2. The perforation tool assembly of claim 1, wherein the coupling comprises the collet propped by the sleeve and the collet engaged with a groove located on the perforation gun.

3. The perforation tool assembly of claim 1, wherein the energy absorber configured to absorb mechanical energy comprises a washer formed of a ductile metal, and wherein one face of the washer is at least one of crenelated, grooved, slotted, knurled, or saw-toothed.

4. The perforation tool assembly of claim 1, wherein the energy absorber configured to absorb mechanical energy comprises at least one of crushable tube material, crushable honeycomb material, or frangible material.

5. The perforation tool assembly of claim 1, wherein the energy absorber configured to absorb mechanical energy comprises a non-restorative material.

6. The perforation tool assembly of claim 1, further comprising a spring, wherein the coupling further encloses the spring.

7. The perforation tool assembly of claim 6, wherein the spring is a non-linear spring.

8. The perforation tool assembly of claim 6, wherein the spring comprises at least one of a wave-type spring or a Belleville-type spring.

9. A perforation tool assembly, comprising:

a tool string connector having a latch component comprising a collet and a sleeve;

a perforation gun having a latch mate that is configured to engage the latch component to couple the perforation gun to the tool string connector by the collet and the sleeve; and a mechanical energy absorber configured to absorb mechanical energy released by firing one or more perforation guns, wherein the tool string connector and the perforating gun are configured to provide a limited range of motion of the tool string connector relative to the perforation gun when the mechanical energy absorber is not located between the tool string connector and the perforation gun, and wherein the mechanical energy absorber is retained by the tool string connector and the perforation gun.

10. The perforation tool assembly of claim 9, wherein the range of motion of the tool string connector relative to the perforation gun is limited substantially to axial relative motion.

11. The perforation tool assembly of claim 10, wherein the range of motion of the tool string connector relative to the perforation gun is limited to less than 2 inches, and wherein the coilet is configured to engage groove located on the perforation gun.

12. The perforation tool assembly of claim 9, wherein the mechanical energy absorber comprises a washer that has one face that is at least one of crenelated, grooved, slotted, knurled, or saw-toothed.

13. The perforation tool assembly of claim 9, wherein the mechanical energy absorber is configured to absorb energy from a first perforation gun firing at a first time and a second perforation gun firing at a second time, and wherein the first time and the second time are separated by a period of time in a range from about 2 seconds to about 30 seconds.

14. A method of perforating a casing string in a wellbore, comprising:

placing a perforation gun in a wellbore;

placing a mechanical energy propagation management device between the perforation gun and a tool string connector comprising a collet and a sleeve; and coupling the perforation gun to the tool string connector by releasing and sliding the sleeve to prop the collet and to engage the collet with perforation gun, wherein the perforation gun and the tool string connector are configured to move relative to each other within a limited range of motion.

15. The method of claim 14, wherein the perforation gun and the tool string connector are configured to move relative to each other within a limited range of axial motion when the mechanical energy propagation management device is not placed between the perforation gun and the tool string connector.

16. The method of claim 14, further comprising:

modeling the wellbore;

modeling a perforation gun string, wherein the perforation gun string comprises the perforation gun, the tool string connector, and the mechanical energy propagation management device; and designing the mechanical energy propagation management device based on modeling the wellbore and modeling the perforation gun string, wherein the mechanical energy propagation management device is designed before placing the mechanical energy propagation management device between the perforation gun and the tool string connector.

17. The method of claim 16, further comprising selecting the mechanical energy propagation management device from among a plurality of interchangeable mechanical energy propagation management devices based on designing the mechanical energy propagation management device, wherein each of the plurality of interchangeable mechanical energy propagation management devices has a different design parameter.

18. The method of claim 14, wherein the collet engages with a groove located on the perforation gun.

19. The method of claim 14, wherein the perforation gun is part of a perforation gun string and further comprising absorbing at least some of a gun shock energy released by firing at least one perforation gun of the perforation gun string.

20. The method of claim 14, wherein the perforation gun is part of a perforation gun string and further comprising shifting the frequency of at least some of a gun shock energy released by firing at least one perforation gun of the perforation gun string.

* * * * *